United States Patent [19]

Sanford

[11] Patent Number: 4,457,744

[45] Date of Patent: Jul. 3, 1984

[54] MACHINE FOR ERECTING HEXAGONAL DRUM

[75] Inventor: Robert J. Sanford, Newburgh, N.Y.

[73] Assignee: International Paper Company, New York, N.Y.

[21] Appl. No.: 210,851

[22] Filed: Nov. 26, 1980

[51] Int. Cl.[3] ..... B31B 5/26; B31B 1/52

[52] U.S. Cl. ..... 493/126; 493/153; 493/181; 493/309

[58] Field of Search ..... 493/126, 309, 162, 152, 493/153, 136, 181

[56] References Cited

U.S. PATENT DOCUMENTS

| | | | |
|---|---|---|---|
| 1,495,192 | 5/1924 | MacNaughtan | 493/309 |
| 2,759,401 | 8/1956 | Tobey | 93/53 |
| 2,905,066 | 9/1959 | Winkler | 93/55.1 |
| 2,970,740 | 2/1961 | Fowle et al. | 229/38 |
| 3,040,960 | 6/1962 | Younger | 229/38 |
| 3,101,167 | 8/1963 | Styler | 229/41 |
| 3,301,144 | 1/1967 | Reeves | 493/180 X |
| 3,526,352 | 9/1970 | Swett | 229/39 |
| 3,627,193 | 12/1971 | Helms | 229/37 R |
| 3,661,319 | 5/1972 | Koehler | 229/37 |
| 4,065,047 | 12/1977 | Swan | 229/41 |
| 4,166,567 | 9/1979 | Beach, Jr. et al. | 229/23 BT |

*Primary Examiner*—James F. Coan
*Attorney, Agent, or Firm*—Stephen P. Gilbert

[57] ABSTRACT

Method and apparatus for erecting a polygonal carton from a collapsed envelope (blank) are disclosed. The carton is preferably a two-ply hexagonal carton having a bottom that forms automatically as the oppositely disposed sidewall-forming panels of the envelope are separated. An improved envelope for use with the apparatus is also disclosed.

9 Claims, 27 Drawing Figures

112b
118
118
112a
30a
27
27
140
142b
204b
204a 206a
200
202b
202a
30a
44a
44b
44c
88
100
90
94b
92
104
60a
60b
170
38b
38c
62a
62b
50a
46a
50c
80
284c
284b
280

MACHINE FOR ERECTING HEXAGONAL DRUM

BACKGROUND OF THE INVENTION

This invention relates to the field of machines for erecting polygonal paperboard cartons, used for carrying heavy loads, and blanks therefor. Such cartons, and in particular, hexagonal cartons, are well-known. See, for example, U.S. Pat. Nos. 4,166,567, 4,065,047, 3,661,319, 3,526,352, and 3,101,167.

Additionally, a commercially available two-ply carton similar to that shown in U.S. Pat. No. 4,166,567 is known. The commercial carton is manufactured from a collapsed envelope of two paperboard plies, an inner and an outer. Its outer ply has essentially the same construction as that shown in FIG. 3 of the patent. Its inner ply is similar to that shown in FIG. 1 of the patent but it has additional bottom-forming flaps foldably connected to one edge of the inner ply shown in that figure, thus eliminating the need for the bottom insert shown in FIG. 4 of that patent.

The principle disadvantage of the commercial carton is that two people are usually required to set up the carton from the collapsed envelope formed from the two plies. That is due to the large number of panels and flaps that must be folded during erection and the stiffness of the paperboard material. Accordingly, the conventional way of erecting the commercially available hexagonal carton is time-consuming and labor-intensive.

SUMMARY OF THE INVENTION

In accordance with the present invention, the commercial carton has been modified to permit mechanical erection and method and apparatus for such mechanical erection have been developed.

Broadly, the new apparatus sets up the carton from an improved collapsed blank by separating oppositely disposed sidewall-forming panels, wherein the separation causes the bottom-forming panels of the blank to form the bottom of the carton automatically. The machine comprises (a) a plurality of separating means, each movable in two directions that are perpendicular to one another; (b) means for placing the separating means between the sidewall-forming panels so that the separating means contact the insides of the sidewall-forming panels; and (c) means for moving the separating means apart so that they continue to contact the insides of their respective sidewall-forming panels as the separating means are moved apart, thereby moving the sidewall panels apart and erecting the carton.

In another embodiment, the machine comprises (a) a forming station having bottom-supporting means and a plurality of separating means; (b) means for positioning the blank in the forming station so that the bottom-forming panels contact the bottom-supporting means; (c) means for placing the separating means between the sidewall-forming panels so that the separating means contact the insides of the sidewall-forming panels; (d) means for moving the separating means apart from each other, thereby moving the sidewall panels apart and causing the bottom-forming panels to fold inwardly to form the bottom of the carton, the inward folding of the bottom-forming panels causing the sidewall-forming panels to move towards the bottom-supporting means and away from the separating means; (e) means for moving the separating means towards the bottom-supporting means so that the separating means continue to contact their respective sidewall-forming panels as the separating means are moved apart, thereby erecting the carton; (f) means for folding the flaps and securing them to the sides of the carton; and (g) means for ejecting the carton from the forming station.

In other embodiments, there are two separating means horizontally movable along vertically movable means. In another embodiment, pre-opening means are vertically horizontally movable to move the opposing sidewall-forming panels apart sufficiently to facilitate placement of the separating means between the sidewall-forming panels.

The process of this invention comprises (a) positioning the blank in a forming station so that the bottom-forming panels contact a bottom-supporting means; (b) placing separating means between the sidewall-forming panels so that the separating means contact the insides of the sidewall-forming panels; (c) moving the separating means apart, thereby moving the sidewall-forming panels apart and causing the bottom-forming panels to fold inwardly, the inward folding causing the sidewall-forming panels to move towards the bottom-supporting means and away from the separating means; and (d) moving the separating means towards the bottom-supporting means during step (c) so that the separating means continue to contact their respective sidewall-forming panels.

The improved blank of this invention is an envelope comprising (a) a one-piece inner reinforcing ply comprising (i) six foldably connected, substantially rectangular sidewall-forming panels arranged in a row and having a common bottom edge; (ii) two substantially rectangular bottom-forming panels, each foldably connected along the bottom edge to one of two non-adjacent panels of the six, said non-adjacent panels being separated by two other panels of the six; and (iii) four triangular bottom-forming panels, each foldably connected along the bottom edge to one of the other four sidewall-forming panels; (b) a one-piece outer body ply having two foldably connected bottom-forming panels and two sets of foldably connected, substantially rectangular sidewall-forming panels, each set comprising a central and two lateral panels arranged in a row, each central panel foldably connected to one of the bottom-forming panels of this outer ply; wherein all twelve sidewall-forming panels of the two plies are substantially the same size and shape and the inner and outer plies are folded and attached to each other so that (i) each of the six sidewall-forming panels of the inner ply lies against and is attached to only one of the six sidewall-forming panels of the outer ply; (ii) the two non-adjacent sidewall-forming panels of the inner ply face each other and lie between the two central sidewall-forming panels of the outer ply; (iii) the two substantially rectangular bottom-forming panels of the inner ply face each other and lie between the two bottom-forming panels of the outer ply; and (iv) the four triangular bottom-forming panels of the inner ply lie in two sets of two with the two panels in each set facing each other; and (c) hinge means connecting each triangular bottom-forming panel to the other one in its set; whereby when the envelope is set up to form the carton, the four triangular and two substantially rectangular bottom-forming panels of the inner ply and two bottom-forming panels of the outer ply fold inward to form the bottom portion of the carton.

The hinge means comprise the modification to the commercial envelope required to allow the machine of this invention to set up the carton from that envelope. Without the hinge means the triangular bottom-forming panels will not fold inward.

BRIEF DESCRIPTION OF THE DRAWINGS

To facilitate description of the present invention, the following drawings are provided in which:

FIG. 8 is a partial perspective view of the preferred machine of this invention;

It should be understood that for the sake of clarity, certain elements have been omitted from all views of the preferred apparatus and elements shown in one figure may be omitted from other figures. The omitted elements not shown in any of the drawings include some of the members of the machine's superstructure, all pneumatic tubing and electrical wiring, the glue system (except for the glue nozzles), and the control panel (containing switches, indicator lights, timers, etc.). The design, placement, and operation of these omitted elements will be obvious to one skilled in the art.

It should also be understood that the drawings are provided for illustrative purposes only and should not be construed to limit the scope of the invention.

DETAILED DESCRIPTION OF THE INVENTION

Figure 1:
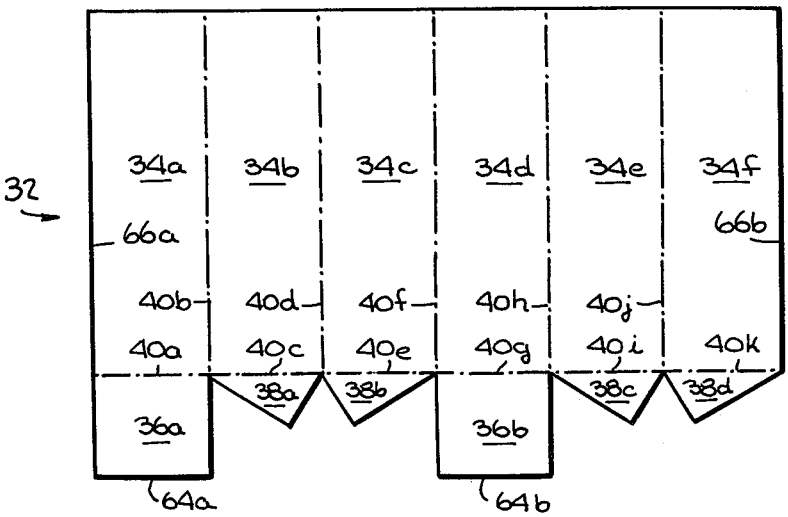
FIG. 1 is a plan view of the preferred inner ply of the hexagonal carton of this invention.

The inner ply used in the collapsed envelope from which the hexagonal carton is formed is shown in FIG. 1. One-piece reinforcing ply 32 comprises six foldably connected substantially rectangular sidewall-forming panels 34. (It will be understood that when a reference character is mentioned, all characters having the same numeric portion but different alphabetic suffixes are meant, unless the context indicates otherwise. For example, "sidewall-forming panels 34" means panels 34*a*, 34*b*, 34*c*, 34*d*, 34*e*, and 34*f*.) Panels 34 are connected at fold lines 40*b*, 40*d*, 40*f*, 40*h*, and 40*j*. Fold lines 40*a*, 40*c*, 40*e*, 40*g*, 40*i*, and 40*k* are colinear and form a common bottom edge. Panels 34*a* and 34*f* are bounded by side edges 66. Non-adjacent sidewall-forming panels 34*a* and 34*d* are separated by two other sidewall-forming panels, 34*b* and 34*c*, and are foldably connected to substantially rectangular bottom-forming panels 36*a* and 37*b*, respectively, having bottom edges 64. The four other sidewall-forming panels are foldably connected to four triangular bottom-forming panels 38.

Figure 2:
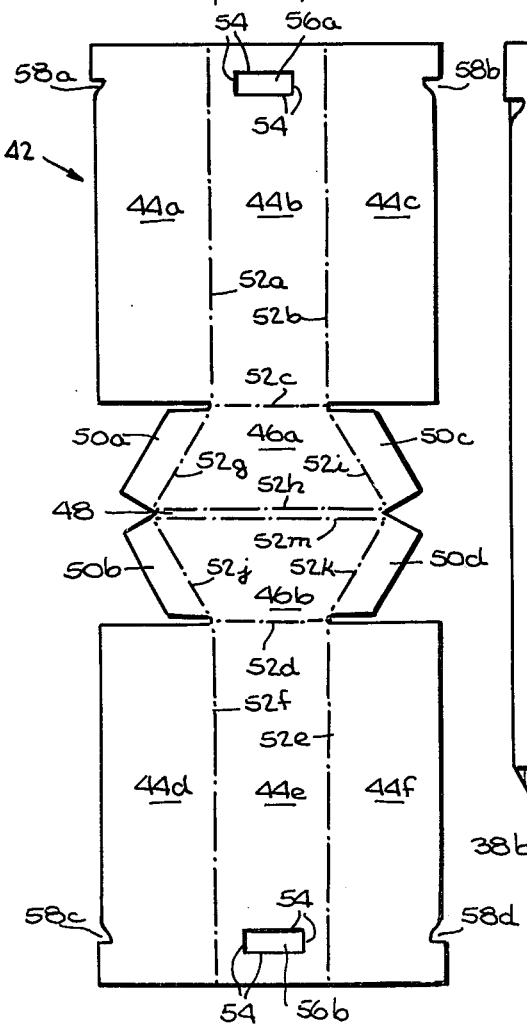
FIG. 2 is a plan view of the preferred outer ply of the same carton.

FIG. 2 shows preferred one-piece outer ply 42 of the hexagonal carton of this invention. There are two sets of foldably connected substantially rectangular sidewall-forming panels. One set comprises central panel 44*b* and lateral panels 44*a* and 44*c*; the other set comprises central panel 44*e* and lateral panels 44*d* and 44*f*. Central sidewall-forming panels 44*b* and 44*e* each have cut lines 54 defining openings 56. A closure or cap (not shown) may be placed on the erected carton. Cap-locking tabs are received in openings 56 to retain the cap. Notches 58 in the four lateral sidewall-forming panels aid in retaining strapping used to help hold the cap in place on the erected carton.

Bottom-forming panels 46 are foldably connected to central panels 44*b* and 44*e* at fold lines 52*c* and 52*d*, respectively. Bottom-forming panels 46 are connected to minor bottom panel 48 at fold lines 52*h* and 52*m*. Glue flaps 50 are connected to bottom-forming panels 46 at fold lines 52*g*, 52*i*, 52*j* and 52*k*. Outer ply 42 is symmetrical about minor bottom-forming panel 48. Inner ply sidewall-forming panels 34 are substantially the same size and shape as outer ply sidewall-forming panels 44.

One way of forming the collapsed blank (or envelope) 30 from which the carton of this invention is manufactured is as follows. Inner reinforcing ply 32 is folded on fold lines 40*d* and 40*j* so that panels 34*a* and 34*b* lie below panels 34*d* and 34*c*, respectively, panel 34*f* lies below panel 34*e*, and side edges 66*a* and 66*b* meet. Outer body ply 42 is folded along fold lines 52*h* and 52*m* so that panels 44*a*, 44*b*, and 44*c* lie above and face panels 44*d*, 44*e*, and 44*f*, respectively, and glue flaps 50*a* and 50*c* and bottom-forming panel 46*a* lie above and face glue flaps 50*b* and 50*d* and bottom-forming panel 46*b*, respectively.

Folded inner ply 32 is then placed within folded outer ply 42 so that inner ply non-adjacent sidewall-forming panels 34*d* and 34*a*, which are facing one another, lie between outer ply central sidewall-forming panels 44*b* and 44*e*, with each inner ply panel 34 attached (preferably glued) to only its respective outer ply panel 44. In this configuration, fold lines 52*a*, 52*b*, and 52*c* are closely adjacent to inner ply fold lines 40*f*, 40*h*, and 40*g*, respectively, and outer ply fold lines 52*d* and 52*f* are closely adjacent to inner ply fold lines 40*a* and 40*b*, respectively. Outer ply fold line 52*e* is closely adjacent to the line at which inner ply side edges 66*a* and 66*b* meet. Inner ply bottom-forming panels 36*a* and 36*b* face each other and lie between outer ply bottom-forming panels 46.

Figure 3:
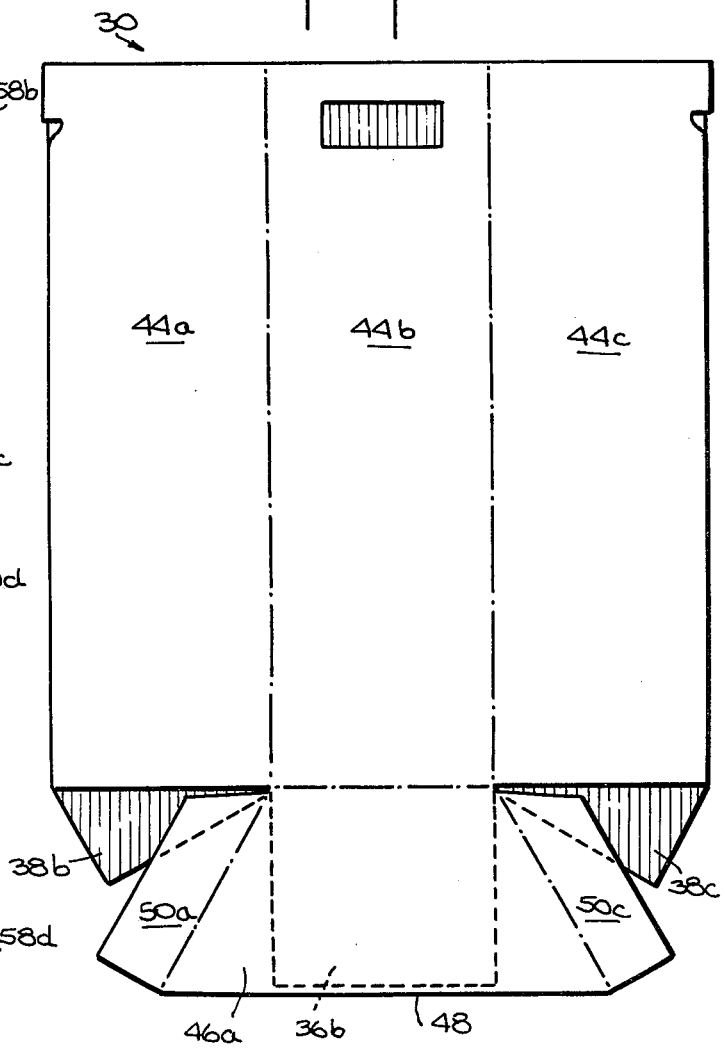
FIG. 3 is a side view of the collapsed envelope (from which the carton is formed) made from the inner and outer plies of FIGS. 1 and 2.
Figure 4:
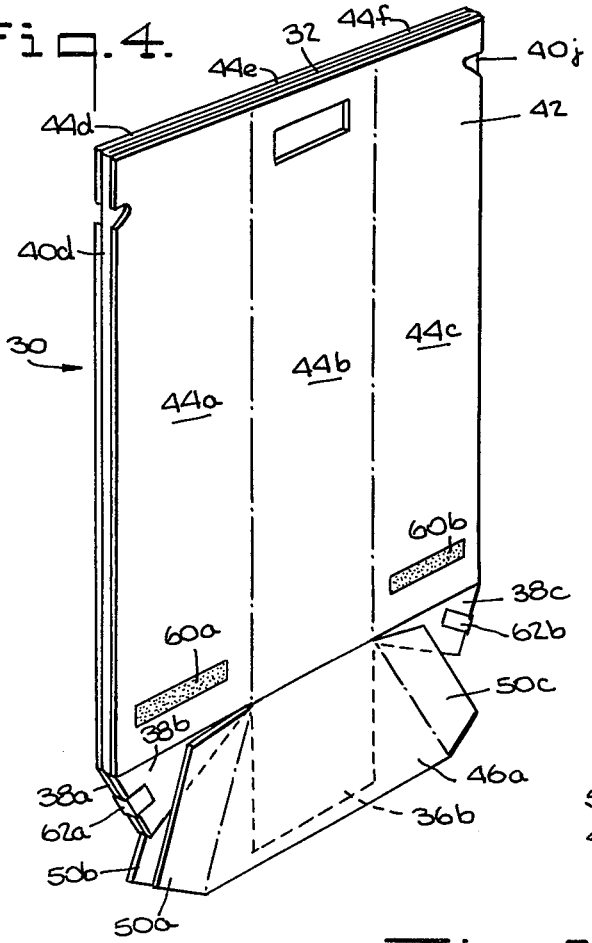
FIG. 4 is a perspective view of the envelope of FIG. 3 with the hinge means attached to the triangular bottom-forming panels of the inner ply.

FIG. 4 is a perspective view of collapsed envelope 30 of FIG. 3. Inner ply bottom-forming triangular panels 38*a* and *b* face each other and lie in part between glue flaps 50*a* and 50*b*. Triangular panels 38*c* and *d* (*d* not shown) face each other and lie in part between glue flaps 50*c* and *d* (*d* not shown). The four triangular bottom-forming panels 38 are, thus, arranged in two sets of two. Hinge means 62*a* (adhesive tape) connects triangular panel 38*a* with 38*b*, and hinge means 62*b* (adhesive tape) connects triangular panel 38*c* with 38*d*. Also shown are glue lines 60*a* and 60*b* on panels 44*a* and 44*c*, respectively. Similar glue lines are present on the other side of collapsed envelope 30 but are not shown.

Figure 5:
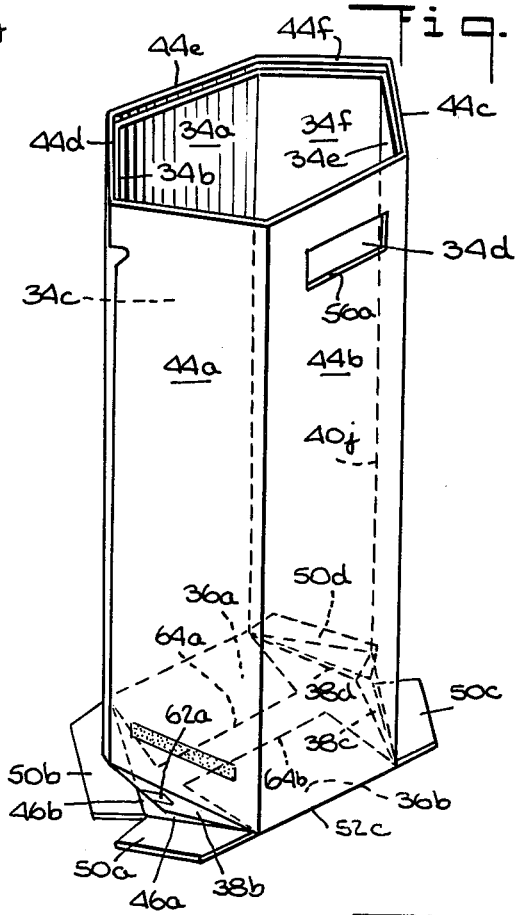
FIGS. 5 to 7 show various steps in erecting the finished carton of FIG. 7 from the collapsed envelope of FIG. 4.

In FIG. 5, panels 34*a* and 44*e*, forming one wall of the carton, have been separated from oppositely disposed panels 34*d* and 44*b*, forming the opposite wall of the carton. As a result of this separation, fold lines 52*c* and *d* (*d* not shown) have broken and outer ply bottom-forming pane 46 and 48 have been pulled inward. That, in turn, causes inner ply fold lines 40*a* and 40*g* to break as bottom-forming panels 36*a* and 36*b* are pushed inward by panels 46*a* and 46*b*. Additionally, because hinge means 62*a* connects triangular panel 38*a* (not shown) and 38*b*, those two panels pull each other inward as inner ply sidewall-forming panels 34*b* and 34*c*, to which they are connected, are separated. Analogously, triangular panels 38*c* and 38*d* pull each other inward as panels 34*e* and 34*f* are separated.

Without hinge means 62, triangular panels 38 will not fold inward during separation of the sidewall-forming panels. Hinge means 62 are, thus, necessary for the functioning of preferred carton-erecting apparatus 70, described below.

Figure 6:
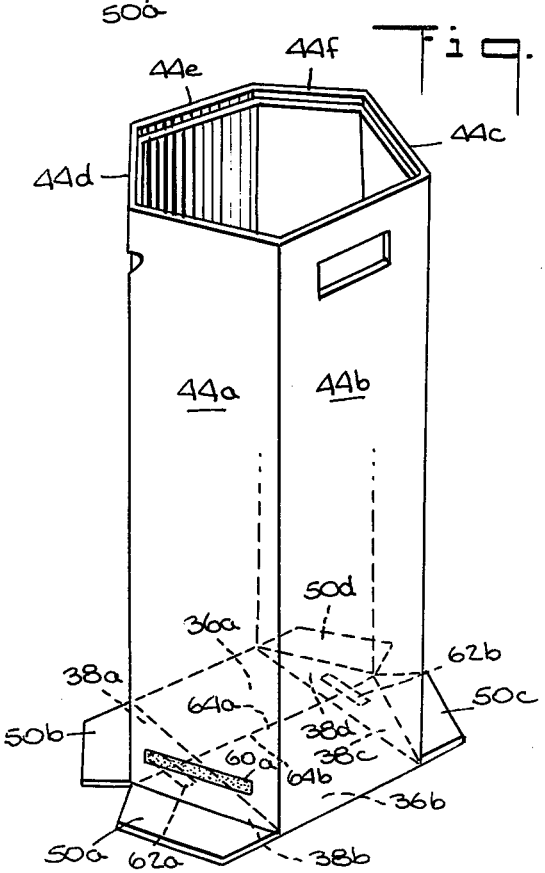
Figure 7:
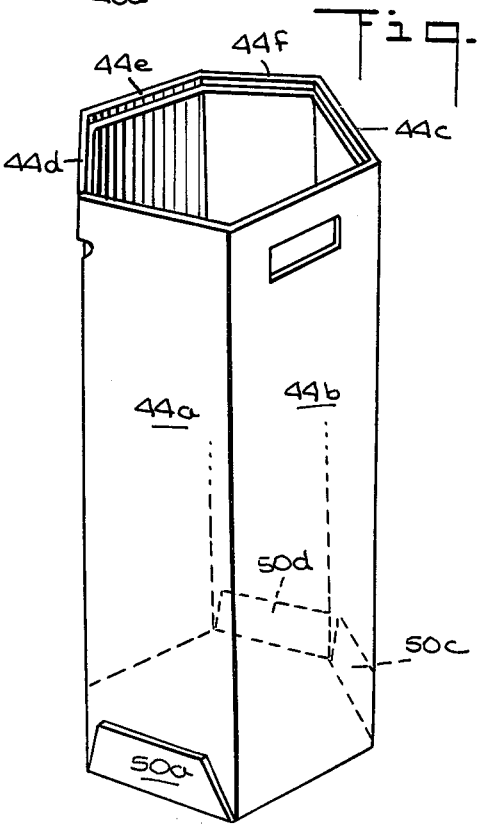
Figure 6:
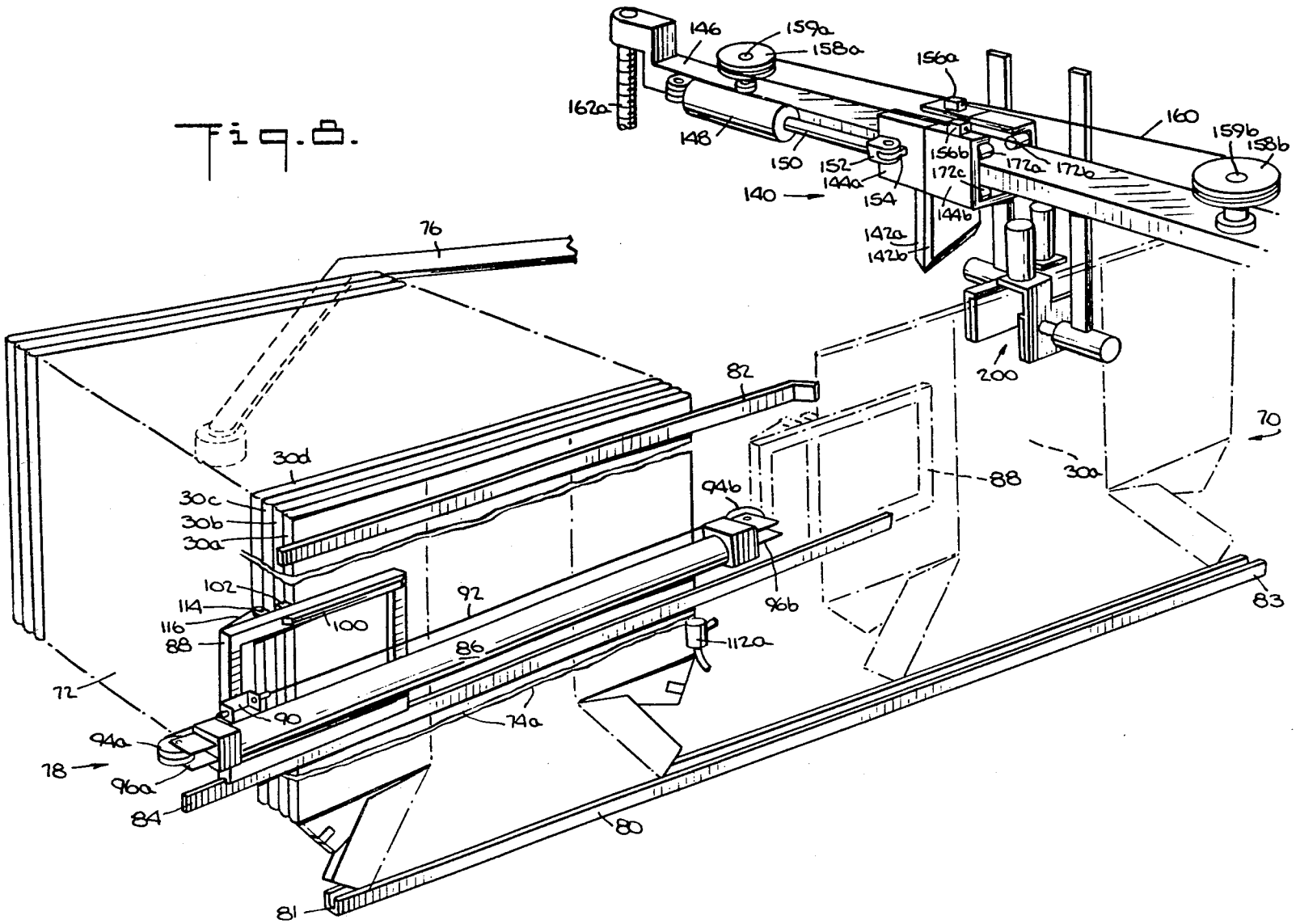

In FIG. 6, panels 44*b* and 44*e* have been separated as far as possible. As a result, edges 64*a* and 64*b* of inner bottom-forming panels 36*a* and 36*b* have now been brought together and the two panels 36 now lie in the same plane as the four triangular panels 38. Outer ply bottom-forming panels 46 and 48 (not shown) are coplanar and lie below inner ply panels 36 and 38. Set-up of the carton with its automatically-forming bottom is completed by folding glue flaps 50 up and securing them to sidewall-forming panels 44*a*, 44*c*, 44*d*, and 44*f* (FIG. 7).

Preferred apparatus 70 for erecting the hexagonal carton of this invention is shown in FIG. 8. Stack 72 of collapsed envelopes 30 is located in the stacking section of the machine and is urged against guide bars 82 and 84 and pusher 88 by feed arm 76. Outer ply bottom-forming panel 48 rides in guide rail 80, which extends from its stacking end 81 to its forming end 83. Pusher assembly 78 comprises pusher 88, cable cylinder 86, pulley brackets 96, pulleys 94, cable 92, and bracket 90, which connects cable 92 to pusher 88. When pusher 88 moves towards the forming station at end 83 of rail 80, finger 102 pushes against the trailing edge of adjacent envelope 30*a*. The locations of pusher 88 and envelope 30*a* in the forming station under opening assembly 140 at the end of their travel are shown in phantom lines.

In opening assembly 140 are separating fingers 142*a* and 142*b*, attached to brackets 144*a* and 144*b*, respectively, which ride on rollers 172 along compression bar 146. Compression bar 146 is mounted on threaded rods (or screws) 162 (only one of which is shown) so that it is reciprocatingly movable vertically.

When double-actuated air cylinder 148 is pressurized to extend piston arm 150, bracket 144*a* and, thus, finger 142*a* are pushed to the right along bar 146 through linkage comprising clevis 152 at the end of arm 150, rotatably connected to ear 154 on the bracket. That, in turn, causes cable 160 to travel clockwise because the cable is fixedly connected to bracket 144*a* at block 156*a*. The cable, riding on pulleys 158, which are mounted on shafts 159, at the same time pulls bracket 144*b* and, thus, finger 142*b* to the left because cable 160 is fixedly attached also to bracket 144*b* at block 156*b*. Accordingly, pressurization of cylinder 148 to extend piston arm 150 causes fingers 142 to move together. Similarly, pressurization to retract arm 150 causes fingers 142 to move apart. The apparatus is designed so that fingers 142 meet within the same plane that the oppositely disposed inner ply sidewall-forming panels of envelope 30*a* meet.

Also shown in FIG. 8 is pre-opening assembly 200, which will be described below, and one of two glue guns 112. Break-lines 74 indicate the vertical compression of the stacked envelopes for purposes of these drawings.

Figure 9:
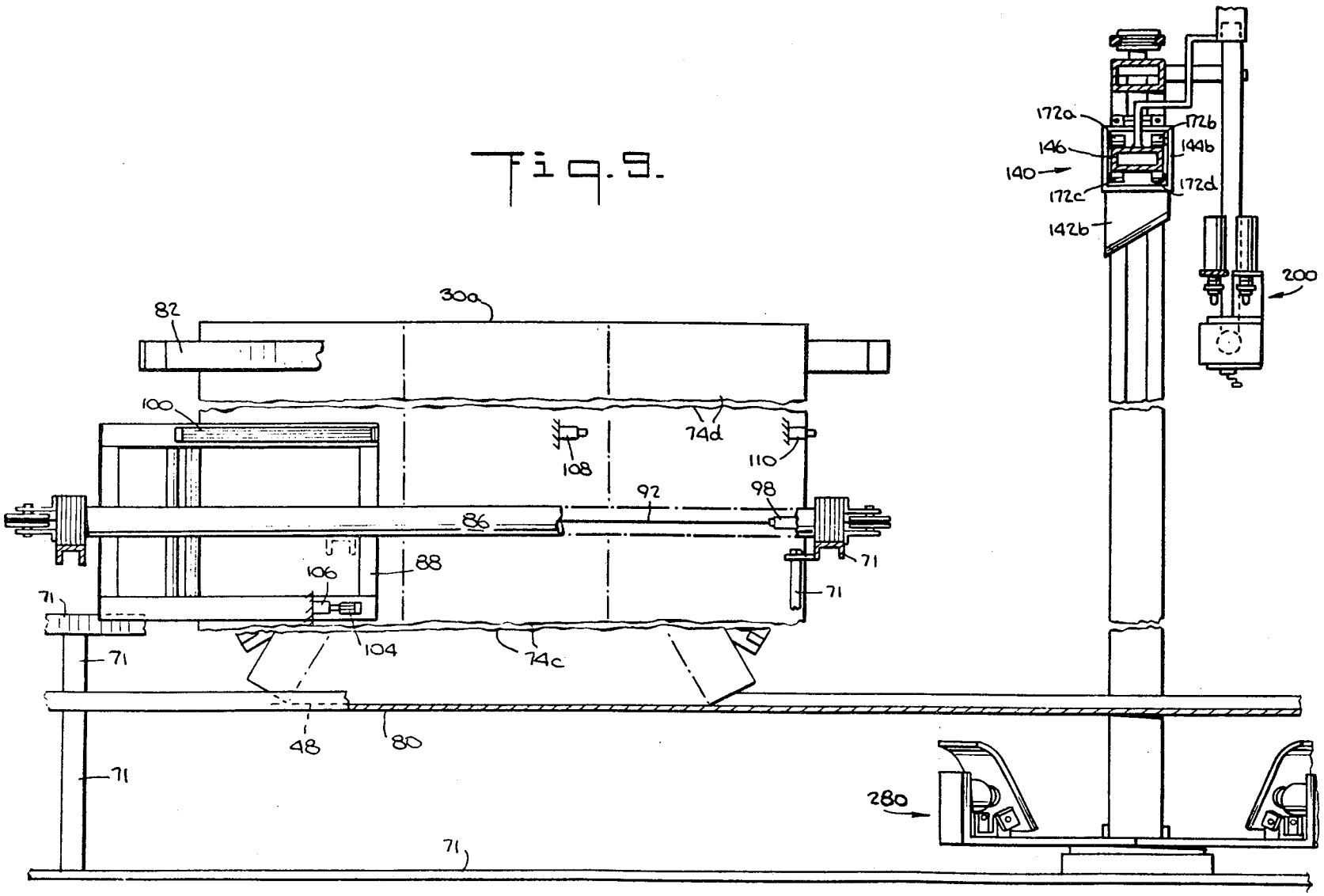
FIG. 9 is a partial side view of the machine of FIG. 8.

FIG. 9 shows the relative locations of opening assembly 140, pre-opening assembly 200, and glue flap folding assembly 280. Piston 98 is visible in the cut-away view of cable cylinder 86, which is double air-actuated. In this drawing switches 106, 108, and 110, whose function will be described below, are shown. The sensor arm of switch 106 lies to the left of and against cam 104, which is mounted on pusher 88. Various members of the superstructure of the apparatus are designated in this and other drawings by reference numeral 71.

Figure 10:
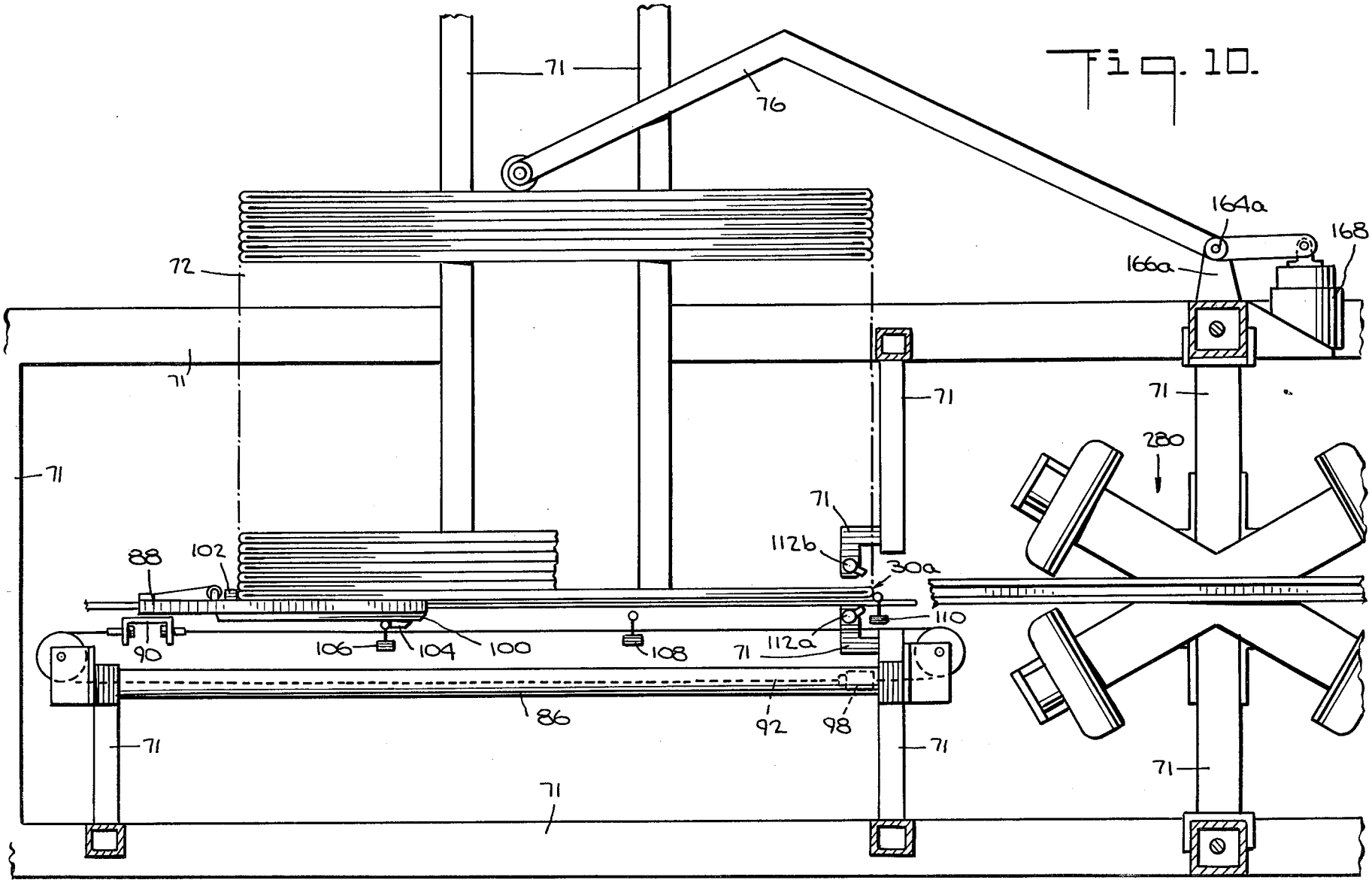
FIG. 10 is a partial plan view of the machine of FIG. 8.

FIG. 10 is a top view of the machine. Feed arm 76 is rotatably mounted on lugs 166 by pins 164 and is biased against the envelopes in stack 72 by air bag assembly 168. Here, both glue guns 112 are visible. The trailing edge of envelope 30*a* lies against block 102 on pusher 88, and the sensor arm of switch 106 lies to the left of and against cam 104 on pusher 88. The leading edge of envelope 30*a* lies to the left of the sensor arm of switch 110.

When double-actuated air cylinder 86 is pressurized to move piston 98 towards the trailing edge of envelope 30*a* (to the left in FIG. 10), cable 92 is moved clockwise, forcing bracket 90 and pusher 88 attached thereto to the right. That causes envelope 30*a* to move from the stacking section to the forming station, that is, to the right in FIG. 10.

Figures 12, 13:
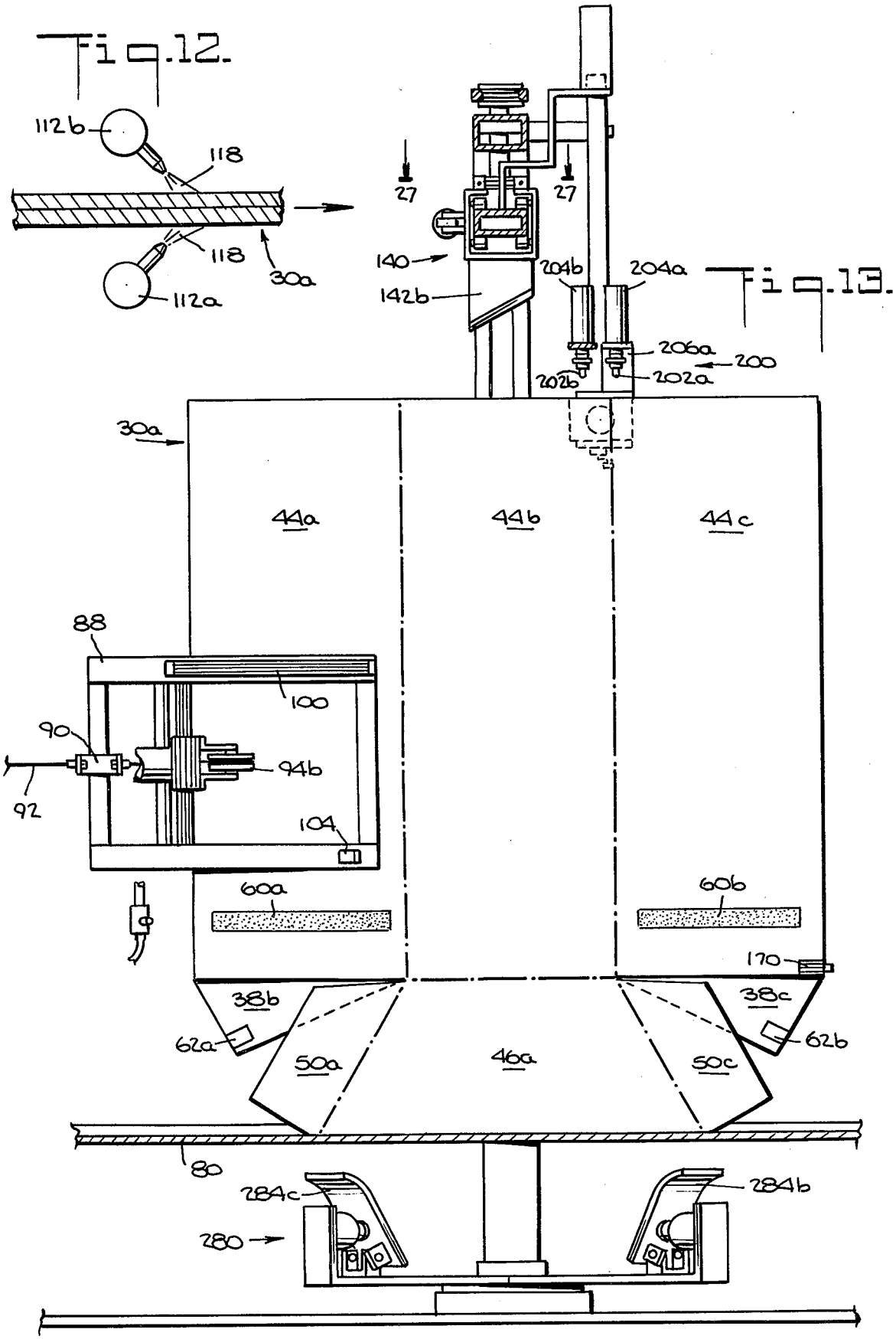
FIG. 12 is a detail view showing the application of glue to the collapsed envelope.
FIG. 13 is a partial side view of the collapsed envelope in the forming section of the machine.

During this transfer, the bottom of the envelope continues to ride in rail 80 (FIG. 9). The leading edge of envelope 30*a* hits and closes switch 110. That activates the glue applying system, causing glue 118 to be shot from glue guns 112 onto both sides of envelope 30*a* (FIG. 12). As pusher 88 and envelope 30*a* continue to travel to the right (FIG. 10), upper cam 100 on pusher 88 hits the arm of switch 108. That turns off the glue applying system because switches 108 and 110 are arranged in series and switch 108 is normally closed. The glue system remains off until the trailing edge of cam 100 has moved far enough to the right to allow the arm of switch 108 to spring back into the position shown in FIG. 10. That turns the glue system on again, since the arm of switch 110 is still being held to the right (closing the switch) by envelope 30*a*. The glue system is finally turned off when the trailing edge of blank 30*a* moves far enough to the right so that the arm of switch 110 springs back to the position shown in FIG. 10. In this manner, glue lines 60 are applied to the envelope (FIG. 4).

Figure 11:
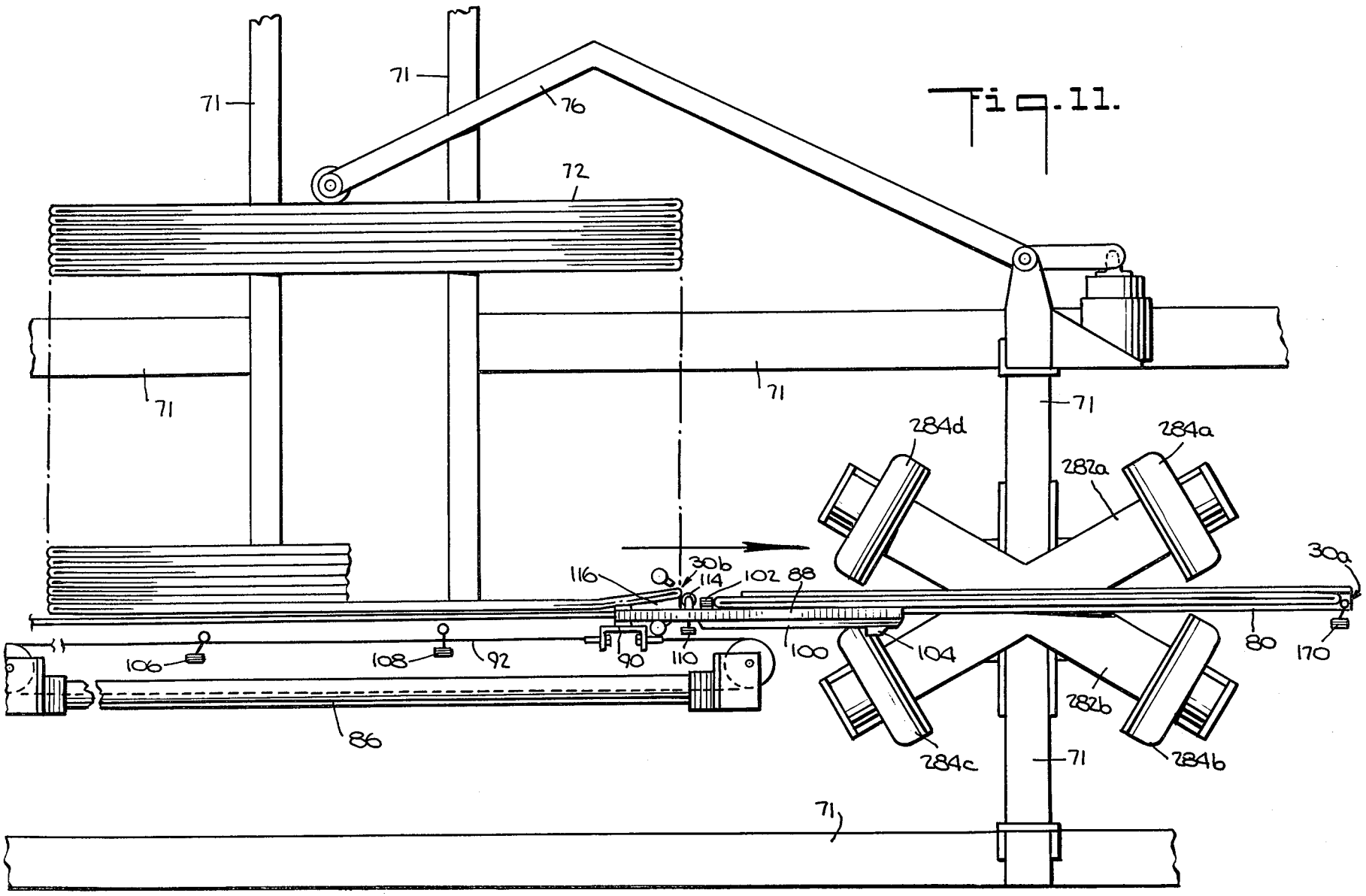
FIG. 11 is a partial plan view of the machine of FIG. 8 with the first collapsed blank from a stack of blanks moved from the stacking section into the forming section of the machine.

Travel of envelope 30*a* to the right is halted when its leading edge hits the sensor arm of switch 170 (FIG. 11). Activation of that switch causes pusher 88 to commence its return trip back to the stacking section, that is, to the left in FIG. 11. Closing of switch 170 also activates pre-opening assembly 200, whose operation will be described below. Incline 116 and roller 114 are positioned on pusher 88 to partially deflect the next envelope 30*b* in stack 72 so that pusher 88 may return to its starting position, that is, to the left in FIG. 11. With pusher 88 and, therefore, cam 100 away from their starting positions in the stacking section, the sensor arm of switch 106 springs to the right. Also shown in FIG. 11 are the four folding plates 284 mounted on crossbars 282.

Figure 14:
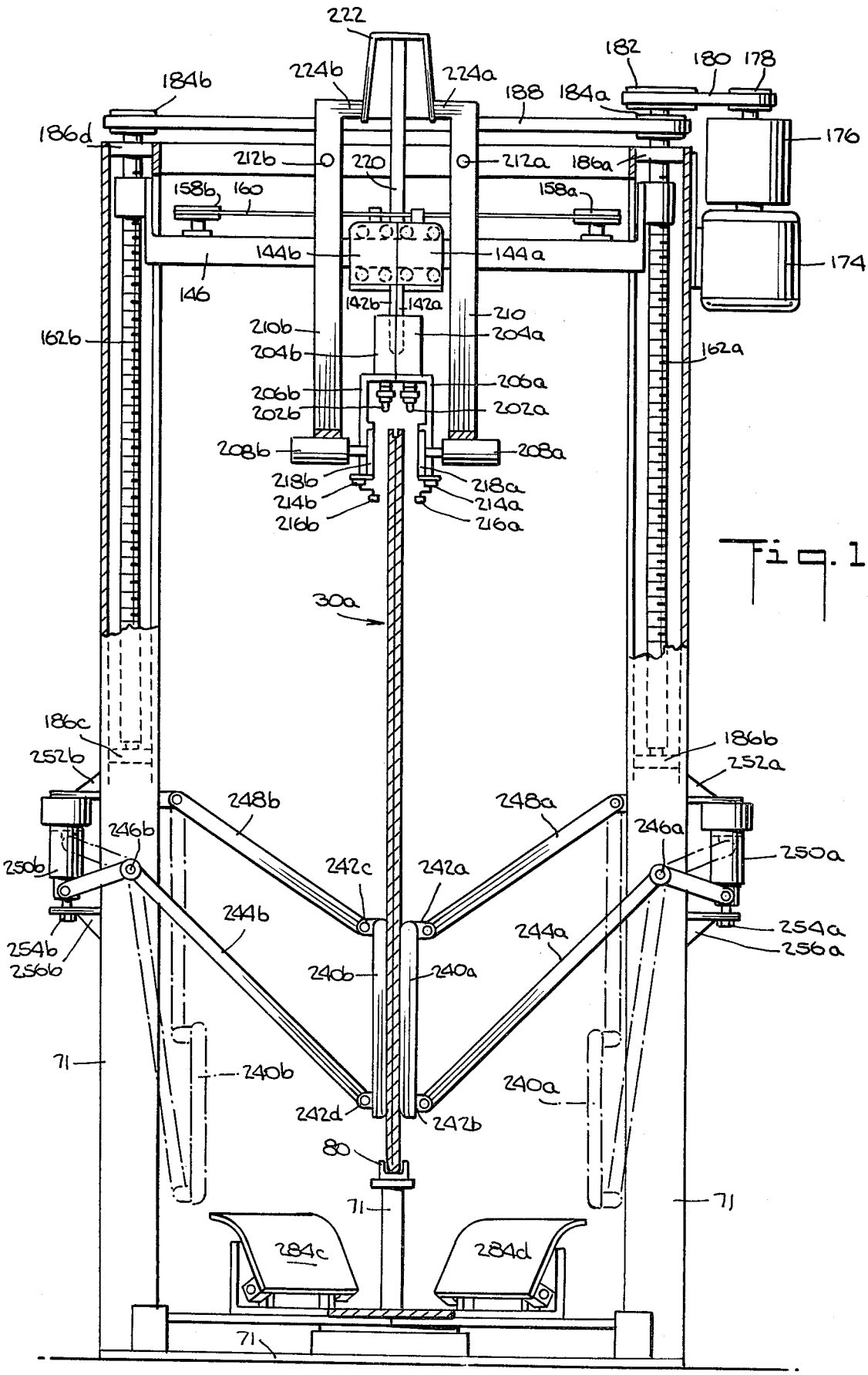
FIG. 14 is an end view of the machine showing the collapsed envelope in the forming station.

FIG. 13 is a side view of envelope 30*a* in the forming station with its bottom-forming panels contacting the bottom-supporting means (rail 80) just before pusher 88 commences its return to its starting position. Turning to FIG. 14, activation of switch 170 has caused support plates 240 to move up from their resting positions (shown in phantom lines) to support the sides of the envelope, in the following manner. Ears 242 on plates 240 are pivotally connected to lower arms 244 and upper arms 248. Lower arms 244 are pivotally mounted on the frame by pins 246. The short sections of arms 244 are pivotally connected to air bag assemblies 250, which are mounted on the frame by lugs 252. When switch 170 is activated, the air bags of assemblies 250 expand, thereby rotating arms 244 and forcing plates 240 up. Downward movement of the movable portions of air bag assemblies 250 and, consequently, the amount of compression applied by plates 240 are controlled by turning adjusting screws 254, which are mounted on the frame in lugs 256.

As described above, separating fingers 142 are connected to brackets 144, which are moved horizontally on compression bar 146 by means of cable 160 on pulleys 158. Compression bar 146 is mounted on screws 162, which are rotatably mounted in bearings 186. V-belt 188 rides on pulleys 184, which are fixedly mounted on screws 162. Pulley 182, fixedly mounted at the top of screw 162*a*, is rotated by motor 174 through gear box 176, drive pulley 178, and drive belt 180. When pulley 178 is rotated in one direction, threaded rods 162 rotate in concert with each other to move compression bar 146 down; when rotated in the opposite direction, compression bar 146 rises. In this way, separating means 142 may be moved back and forth (reciprocatingly) in directions that are perpendicular to one another, that is, vertically and horizontally.

Pre-opening assembly 200 comprises pins 202, which are mounted in air cylinders 204 for vertical movement. Pins 202 are preferably ⅜-inch diameter rod. Cylinders 204 are carried by brackets 206, which are movable laterally with respect to envelope 30*a* by double-actuated air cylinders 208. In turn, air cylinders 208 are carried by swinging arms 210, which are rotatably mounted by pins 212 on the frame of the apparatus. Within each bracket 206 squeezer plates 218 are mounted, and at the bottom of brackets 206 switches 214 having sensing arms 216 are mounted. Support bracket 220, attached to compression bar 146, carries U-shaped spacing bracket 222. When bar 146 is at its highest position, as shown, spacing bracket 222 prevents the bottoms of arms 210 from moving apart because bracket 222 abuts top ends 224 of brackets 210.

Figure 15:
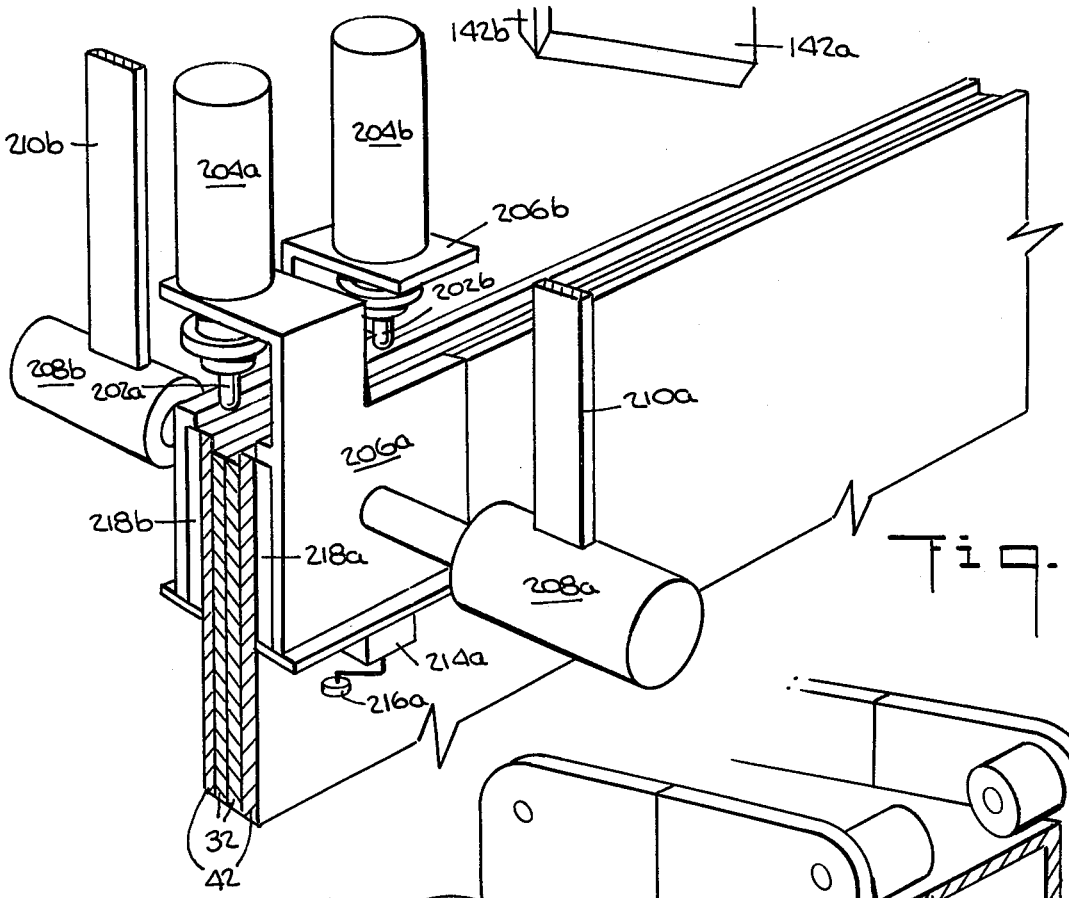
FIG. 15 is a perspective detail view showing the pre-opener pins disposed above the collapsed envelope in the forming station.
Figure 16:
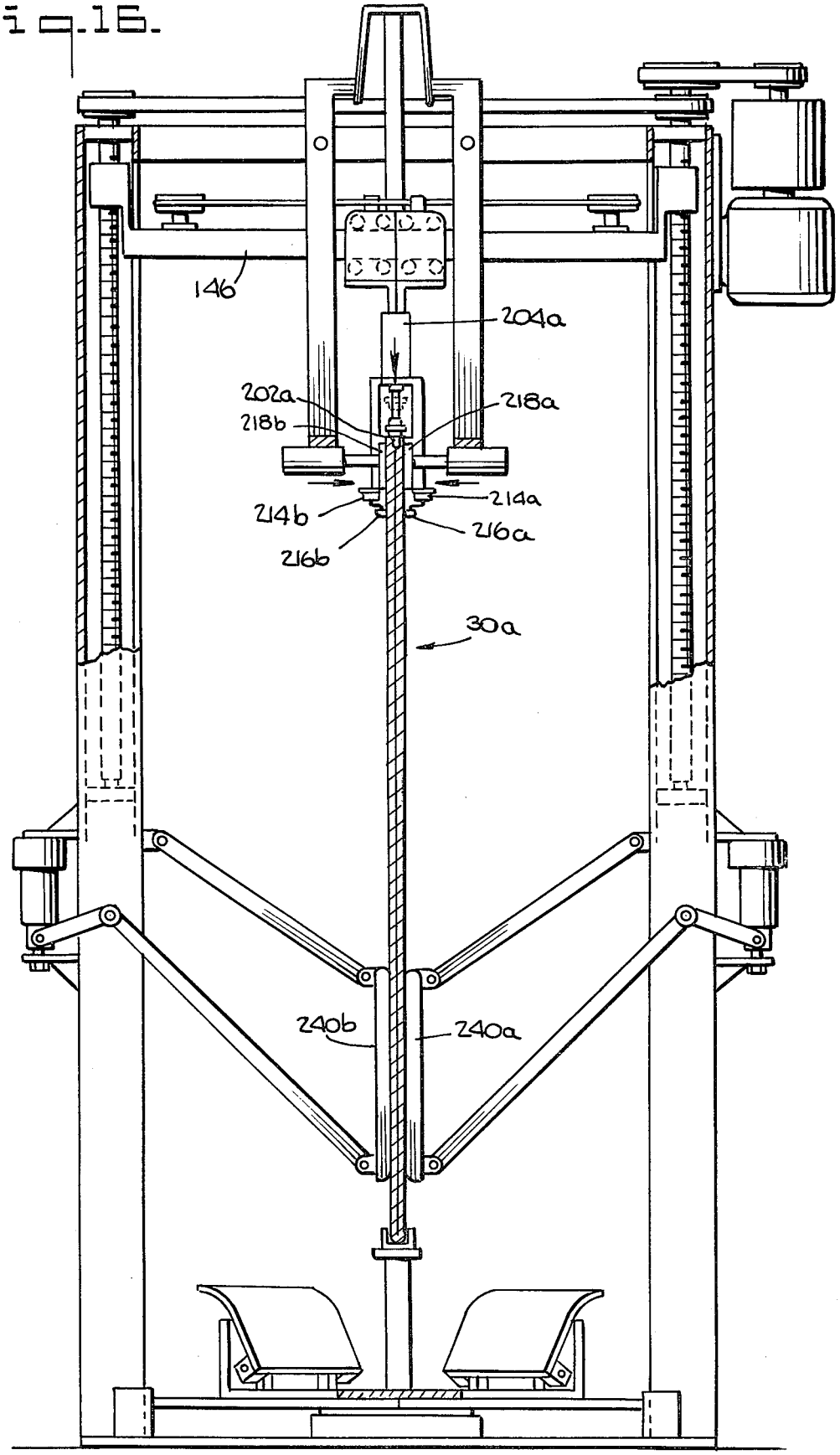
FIG. 16 is an end view of the machine showing the pre-opener pins moving down to separate the sidewall panels of the collapsed envelope.

Activation of the pre-opening assembly by switch 170 (FIGS. 11 and 12) causes air cylinders 208 to pressurize, driving brackets 206 towards each other. As seen in FIG. 15, brackets 206 are constructed so that extension pressurization of air cylinders 208 causes pins 202 to line up to lie in a plane common with the plane in which the two opposing surfaces of inner ply 32 touch. Turning to FIG. 16, inward movement of brackets 206 also brings sensor arms 216 of switches 214 and squeezer plates 218 into contact with envelope 30*a*. Closing of the switches causes extension pressurization of air cylinders 204 (only one of which is shown). That drives pins 202 down into envelope 30*a*.

Figure 17:
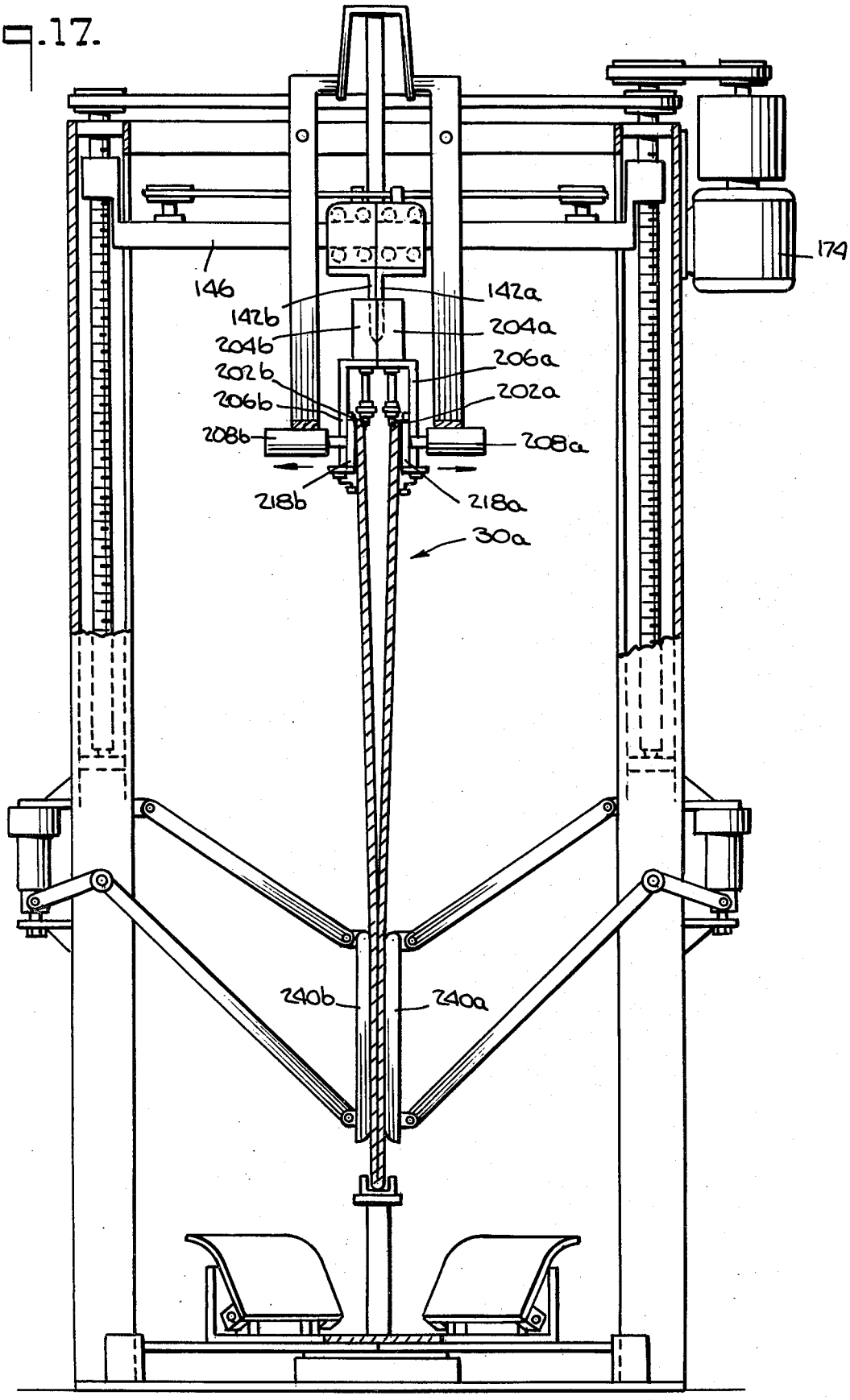
FIG. 17 is an end view of the machine showing the pre-opening pins moved apart to separate the sidewall panels of the collapsed envelope.

During this time, pusher 88 has been traveling back towards its starting position, shown in FIGS. 8, 9, and 10. When pusher 88 first moved away from its starting position, the sensor arm of switch 106 moved to the right, since the arm was biased in that direction (FIG. 11). Upon the return of pusher 88, cam 104 hits the sensor arm and causes it to resume the position shown in FIG. 10. That causes retraction pressurization of air cylinders 208 (FIG. 17). As a result, the sidewall-forming panels of envelope 30*a* are pulled apart (approximately one inch) because each side of the envelope is trapped between its respective pin 202 and its respective squeezer plate 218.

Figure 18:
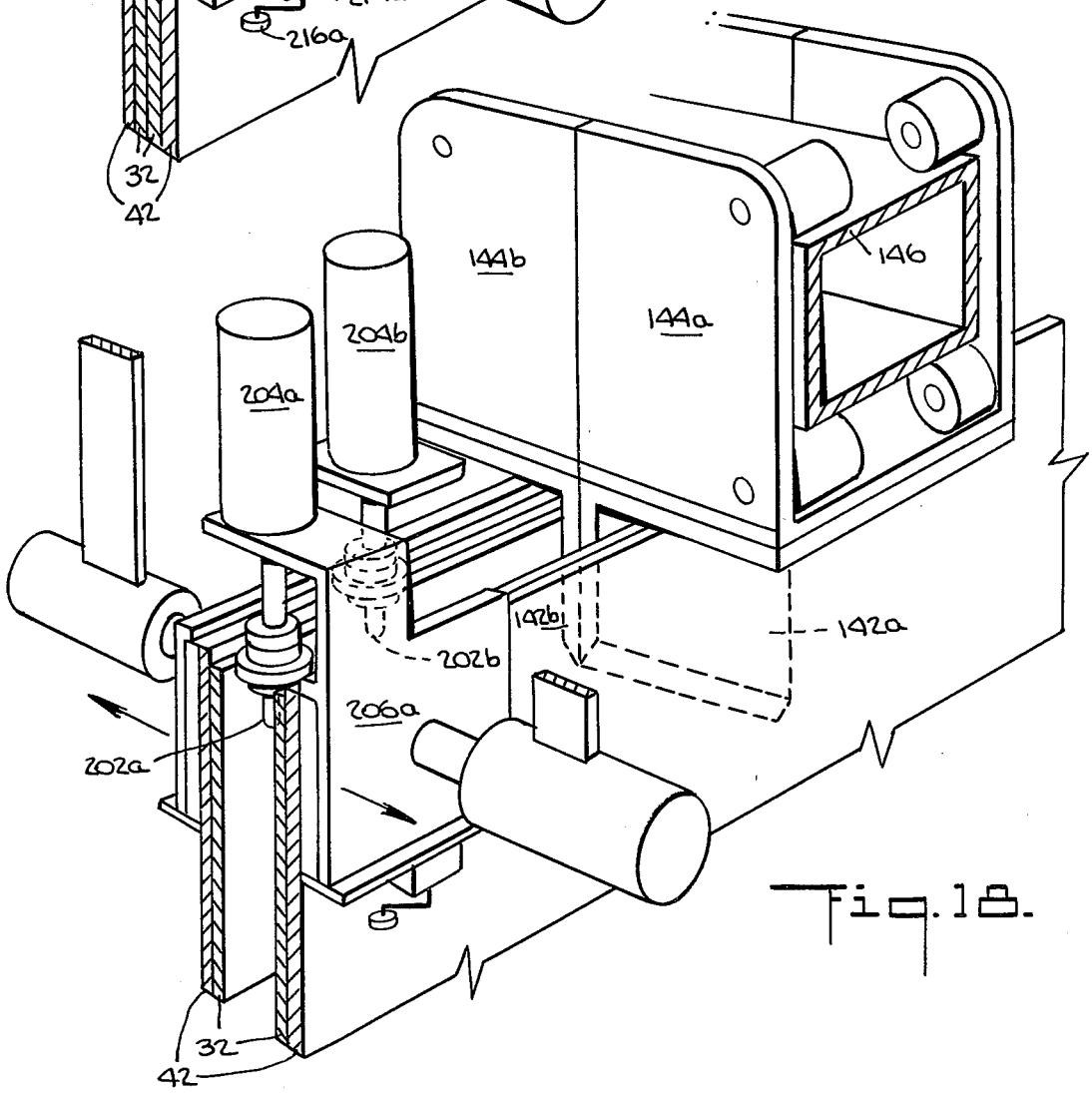
FIG. 18 is a perspective detail view of the separating fingers inserted into the gap between the sidewall-forming panels provided by the pre-opening assembly.

Activation of switch 106 by the return of pusher 88 also causes motor 174 to start to move compression bar 146 down. By the time fingers 142 are brought down to the envelope, the oppositely disposed sidewall-forming panels have been separated, as described above, and the fingers move into the resulting gap as bar 146 continues downward (FIG. 18).

Figure 19:
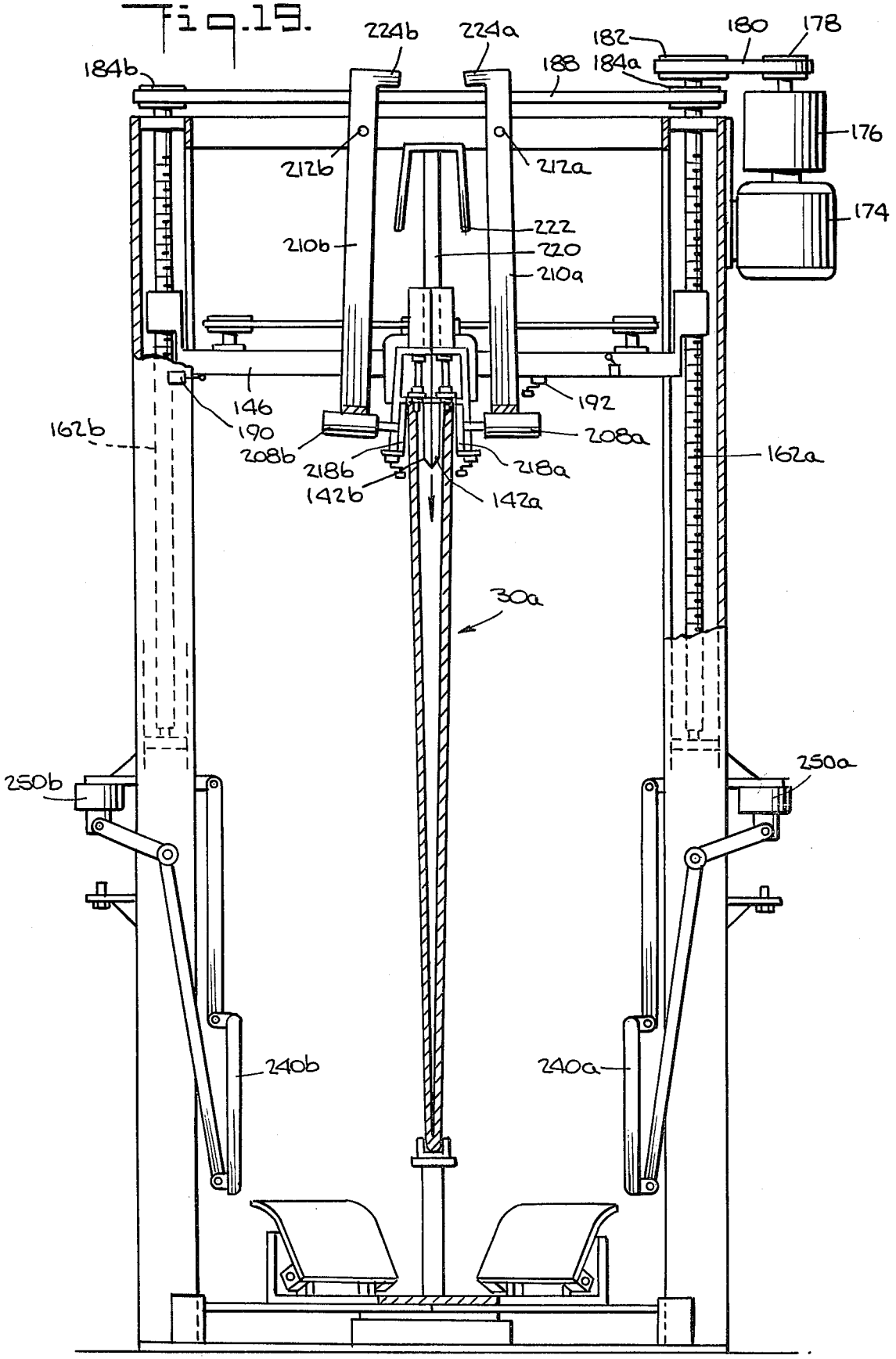
FIGS. 19 to 22 show the separating fingers moved down and apart to force the sidewall-forming panels apart to their maximum and cause the bottom-forming panels to form the bottom of the carton.

When the leading side of bar 146 hits the sensor arm of switch 190 (FIG. 19), the air pressure to air bag assemblies 250 is cut and the weight of plates 240 and of their arms causes those plates to fall away from the walls of envelope 30*a* and assume the position shown. At this point, separating fingers 142 are disposed between the sidewall-forming panels of the envelope, which panels remain trapped between their respective pre-opening pins and squeezer plates. Downward movement of bar 146 has also lowered support bracket 220, thereby moving U-shaped bracket 222 down from between top ends 224 of arms 210. That has permitted bars 210 to rotate on pins 212 so that top ends 224 approach each other.

Figure 20:
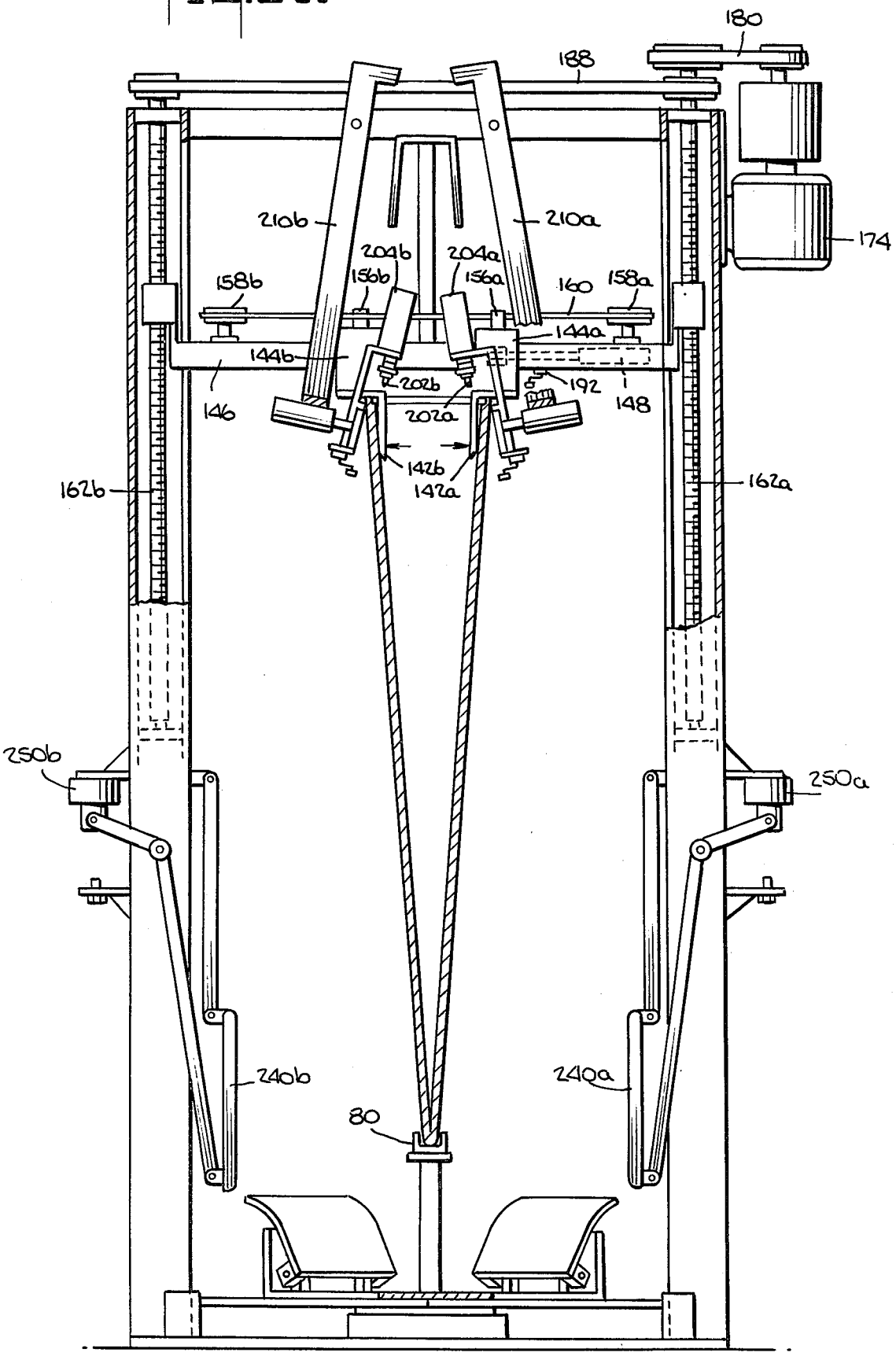

Activation of switch 190 also stops motor 174, temporarily halting downward movement of the bar, and causes retraction pressurization of air cylinder 148 (FIG. 20). As explained above, the latter causes bracket 144*a* (and finger 142*a*) to move to the right and bracket 144*b* (and finger 142*b*) to move to the left. Because each finger continues to contact the insides of its respective sidewall-forming panels as the fingers move apart, the panels are forced apart.

Figure 21:
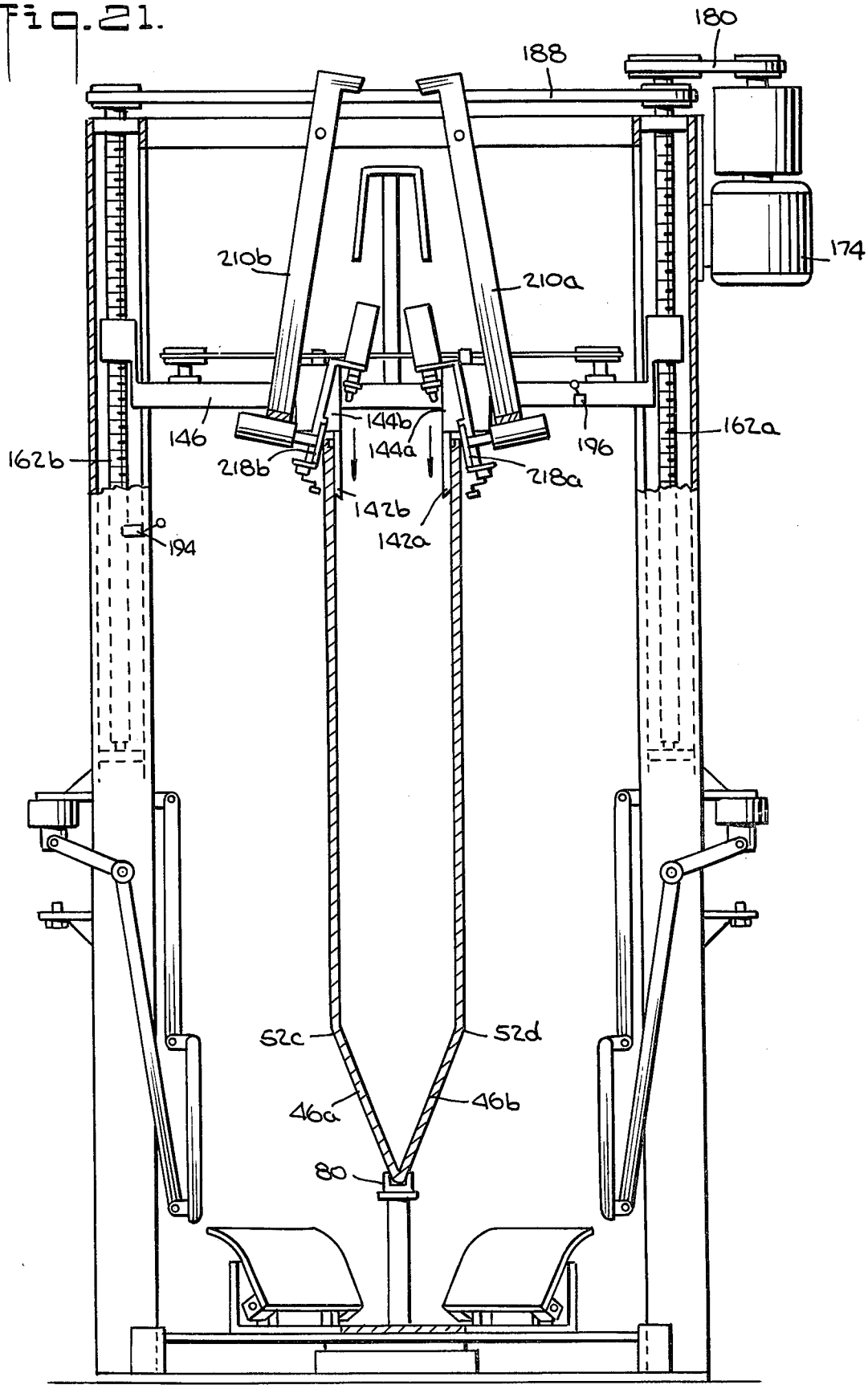

Separation of fingers 142 (and of the sides of the envelope) continues and ultimately bracket 144*a* hits the sensor arm of switch 192, which is located on the lower right side of compression bar 146 As shown in FIG. 21, by the time bracket 144*a* trips switch 192, fold lines 52*c* and 52*d* have broken. Referring momentarily to FIG. 2, fold line 52*c* is located between outer ply central sidewall-forming panel 44*b* and bottom-forming panel 46*a* and fold line 52*d* is located between panels 44*e* and 46*b*.

Figure 22:
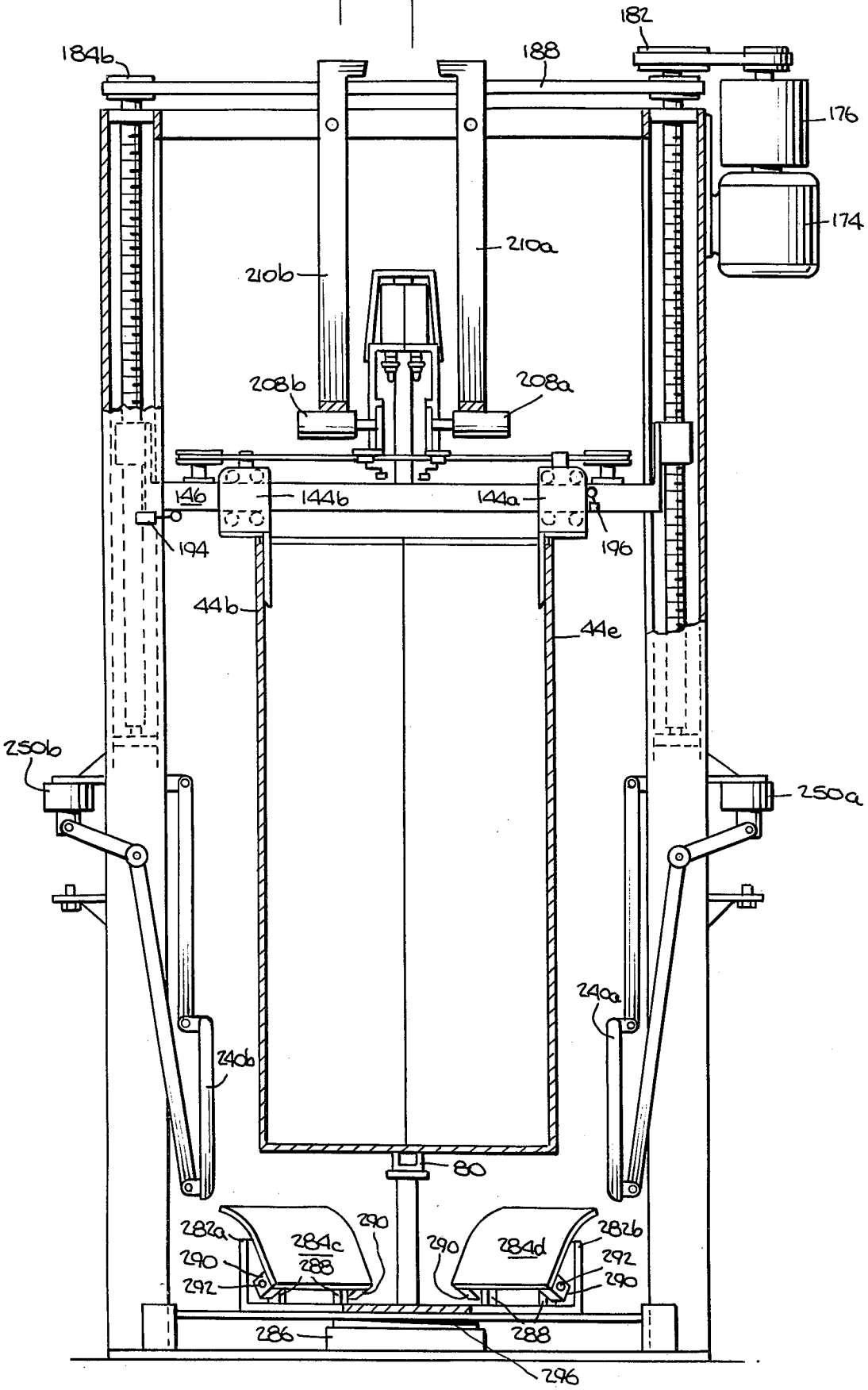

Tripping of switch 192 causes motor 174 to restart and, as a result, compression bar 146 resumes its downward travel. During this time, fingers 142 have continued to move apart. The downward movement of bar 146 continues until it hits the sensor arm of switch 194, and the separation of brackets 144 continues until bracket 144*a* hits the sensor arm of switch 196 (FIG. 22). By this time, the sidewall-forming panels of the envelope have been moved apart and down toward bottom-supporting means (guide rail) 80 as far as possible and the bottom-forming panels have been folded inward to form the bottom of the carton. In this embodiment, the separating means are moved down as the bottom of the carton forms because the sidewalls move down as the bottom of the carton is formed. If the separating means did not move down, at some point the sidewall panels would slip off the separating means unless the separating means were longer than the width of the bottom-forming panels, but that is not preferred.

Figure 23:
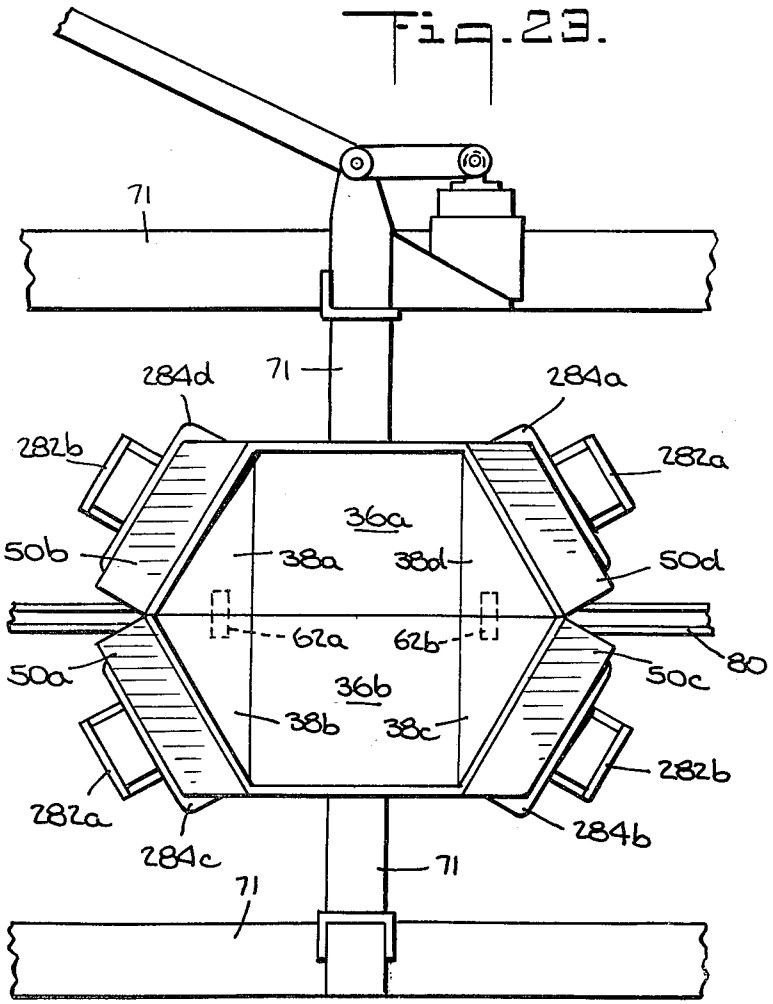
FIG. 23 is a partial overhead view of the erected carton in the forming station with the glue flaps of the carton waiting to be folded upwards and secured to the outside of the carton.

As seen in FIG. 22, folding plates 284 (only two of which are shown) have ears 290 rotatably connected by pins 292 to lugs 288, which are located on crossbars 282. FIG. 23 is an overhead view of the partially erected carton in the forming station, with each folding plate 284 located below its respective glue flap 50.

Figure 24:
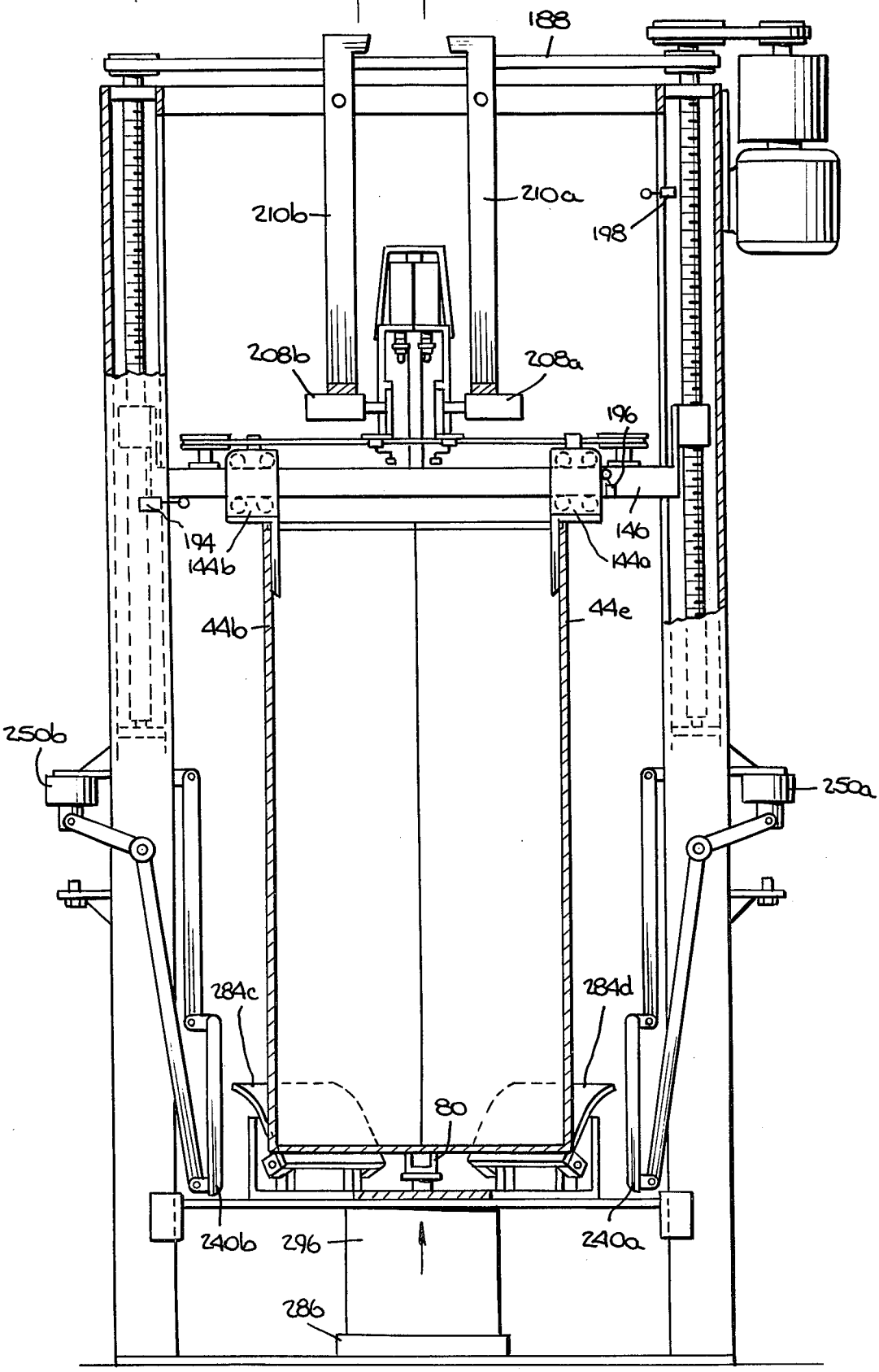
FIG. 24 is an end view of the machine showing the flap-folding assembly moved upwards to bring its folding plates into contact with the glue flaps of the carton.

Activation of switch 194 also causes pressurization of bladder 296 of air bag assembly 286 (FIG. 24). That causes the entire folding assembly to move upwards so that each folding plate 284 (only two of which are shown) contacts its respective glue flap.

Figure 25:
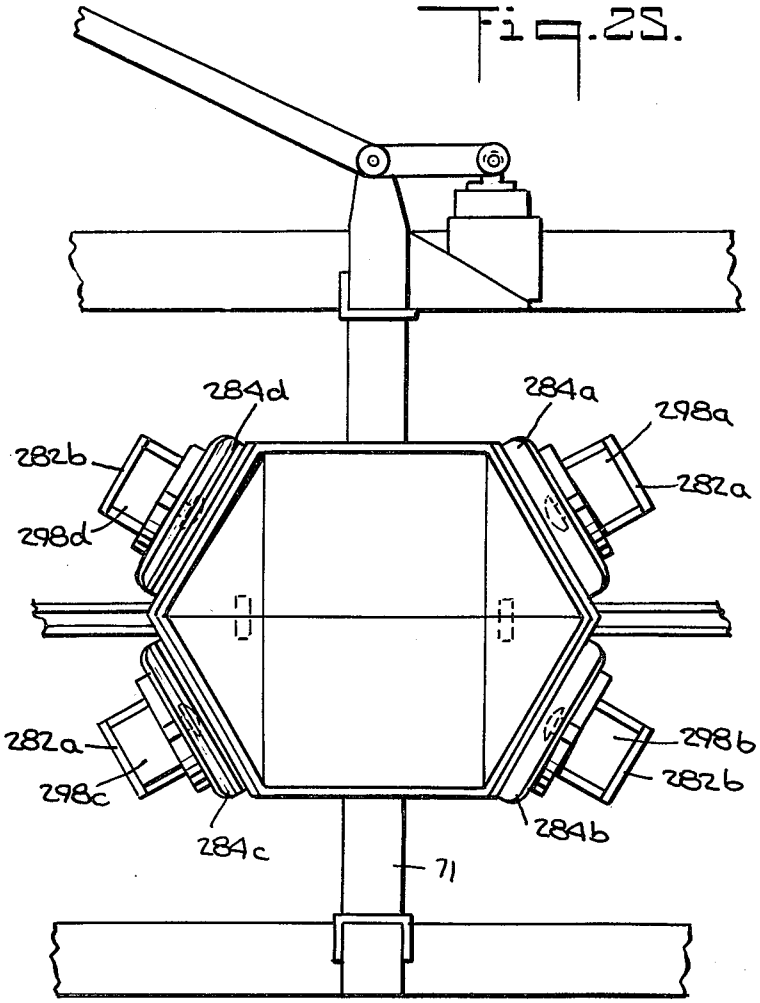
FIG. 25 is a partial overhead view of the forming station of the machine showing the folding plates folded upwards to bring the glue flaps into contact with the outside of the carton.

Turning to FIG. 25, air cylinders 298 are located behind folding plates 284. When the folding assembly reaches its maximum height (FIG. 26), a switch (not shown) causes pressurization of air cylinders 298, thereby rotating folding plates 284 inward. A timer keeps the folding plates in that position, thereby holding the glue flaps against the outside of the carton, until sufficient time has passed for the glue to set. Approximately 15 seconds is required when using cold-set adhesives. Also, upward movement of the flap folding assembly allows switch 300 to open, and that disables pusher 88 so that a new blank cannot be pushed into the forming station to interfere with setting of the glue.

Figures 26, 27:
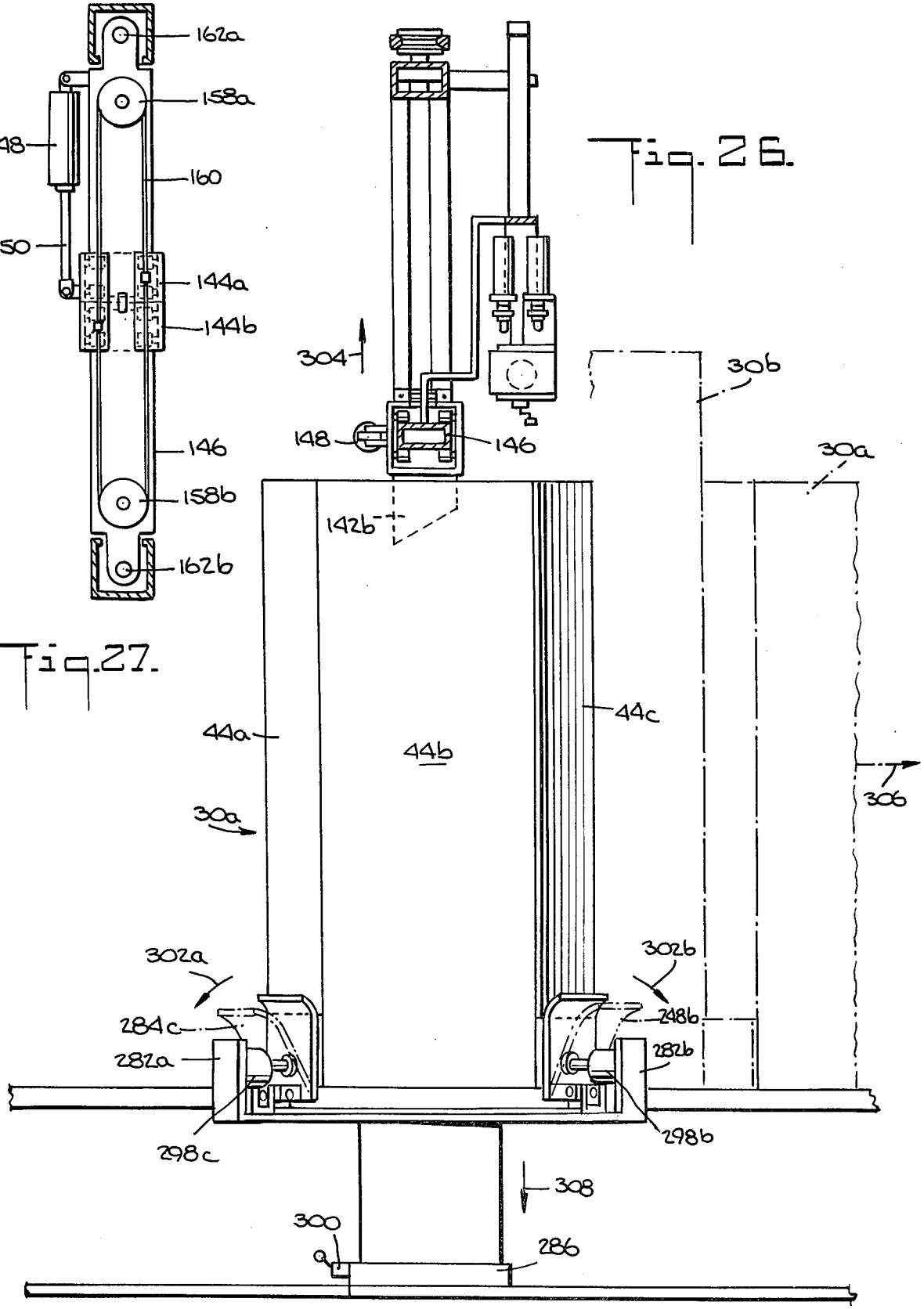
FIG. 26 is a partial side view indicating the downward movement of the folding plates and upward movement of the separating fingers after the carton is fully erected and further indicating the ejection of the erected carton from the forming station by the next collapsed envelope to be moved into the forming station.
FIG. 27 is a partial plan view showing the brackets carrying the separating fingers moved back together to await placement of the next collapsed envelope below them in the forming station.

After sufficient time has passed, air cylinders 298 are depressurized, allowing plates 284 to fold down, as indicated by arrows 302 in FIG. 26. Also, air bag assembly 286 is depressurized, allowing the folding plates and crossbars to move down of their own weight, as indicated by arrow 308. The flap folding assembly ultimately hits the sensor arm of switch 300, causing motor 174 to restart, but in the reverse direction. That raises compression bar 146, as indicated by arrow 304. Activation of switch 300 also causes extension pressurization of air cylinder 148, which moves brackets 144 together again (FIG. 27). The upward travel of compression bar 146 is halted when the leading edge of the bar hits the sensor arm of switch 198 (FIG. 24).

The closing of switch 300 (FIG. 26) also enables pusher assembly 78, causing pusher 88 to move the next envelope 30*b* in stack 72 into the forming station (FIG. 8). As collapsed envelope 30*b* enters the forming station, it pushes fully erected carton 30*a* out of the station in the direction indicated by arrow 306 (FIG. 26). The cycle is then repeated for envelope 30*b*.

Numerous modifications and variations in the apparatus and envelope described will be obvious to those skilled in the art, and the claims are intended to cover all such modifications and variations that fall within the true spirit and scope of this invention. For example, in a preferred embodiment, light-reflective tape will be used on pusher 88 in conjunction with photoelectric cells (instead of switches 108 and 110) to control glue application. Electro-mechanical switches may be used instead of mechanical air switches, although the latter are preferred for simplicity. A chain belt may be substituted for V-belt 188, but latter is preferred because it is quieter. In a preferred embodiment, two double-actuated air cylinders 148 will be used to reciprocate the finger brackets 144 along compression bar 146, each cylinder connected to one bracket.

I claim:

1. A machine for erecting a carton having oppositely disposed sides and a bottom from a blank by separating oppositely disposed sidewall-forming panels wherein the separation causes the bottom-forming panels of the blank to form the bottom of the carton, said machine comprising:

(a) a plurality of separating means, each movable in two directions that are perpendicular to one another;

(b) means for placing the separating means between the oppositely disposed sidewall-forming panels so that each separating means contacts the inside of one of the oppositely disposed sidewall-forming panels; and (c) means for moving the separating means apart linearly and towards the bottom-forming panels so that the separating means continue to contact the insides of their respective oppositely disposed sidewall-forming panels as the separating means are moved apart, thereby moving the oppositely disposed sidewall panels apart linearly to become oppositely disposed sidewall panels in the erected carton.

2. The machine of claim 1 wherein there are two separating means movable horizontally and vertically.

3. The machine of claim 1 for erecting the carton of claim 1 wherein the bottom-forming panels of the carton have flaps foldably attached to them that are folded to secure the bottom to the sides of the carton to maintain the carton in an erected state, said machine further comprising means for folding and securing the flaps to the sides of the carton.

4. A machine for erecting a carton having sides and a bottom from a blank by separating oppositely disposed sidewall-forming panels, the blank having bottom-forming panels foldably connected to the sidewall-forming panels and the bottom-forming panels being foldably connected to flaps that are folded towards and secured to the sides of the carton; said machine comprising:

(a) a forming station having bottom-supporting means and a plurality of separating means;

(b) means for positioning the blank in the forming station so that the bottom-forming panels contact the bottom-supporting means;

(c) means for placing the separating means between the sidewall-forming panels so that the separating means contact the insides of the sidewall-forming panels;

(d) means for moving the separating means apart from each other, thereby moving the sidewall-forming panels apart and causing the bottom-forming panels to fold inwardly to form the bottom of the carton, the inward folding of the bottom-forming panels causing the sidewall-forming panels to move towards the bottom-supporting means and away from the separating means;

(e) means for moving the separating means towards the bottom-supporting means so that the separating means continue to contact their respective sidewall-forming panels as the separating means are moved apart, thereby erecting the carton;

(f) means for folding the flaps and securing them to the sides of the carton; and (g) means for ejecting the carton from the forming station.

5. The machine of claim 4 further comprising means for stacking a plurality of blanks and moving the blanks one at a time into the forming station.

6. The machine of claim 4 wherein the means for moving the separating means towards the bottom-supporting means comprises a first member movable in two directions and the separating means comprise members movable along the first member in directions different from those in which the first member is movable.

7. A machine for erecting a carton having sides and a bottom from a blank by separating oppositely disposed first and second sidewall-forming panels, the blank having bottom-forming panels foldably connected to the sidewall-forming panels and the bottom-forming panels being foldably connected to flaps that are folded towards and secured to the sides of the carton; said machine comprising:

(a) stacking means for holding a stack of blanks;

(b) a forming station;

(c) guide means having a feed end near the stacking means and a forming end in the forming station and on which guide means the blank moves from the feed end to the forming end;

(d) feed means for moving the blanks one at a time from the stack onto the guide means;

(e) pusher means for moving the blank from the feed end of the guide means to the forming end of the guide means;

(f) support means for supporting the sides of the blank in the forming station;

(g) vertically movable compression means in the forming station;

(h) first and second separating means movable horizontally along the compression means;

(i) first and second vertically movable pre-opening means connected to horizontally movable support means in the forming station for moving the sidewall-forming panels apart slightly to facilitate placement of the separating means between the sidewall-forming panels;

(j) means for moving the compression means down as the separating means move apart;

(k) folding means to fold the flaps to the sides of the carton;

(l) means to apply securing means to secure the flaps to the sides of the carton; and (m) means to eject the completed carton from the forming station after the flaps have been secured to the sides of the carton.

8. A process using the machine of claim 4 for erecling a carton having sides and a bottom from a blank having (i) oppositely disposed sidewall-forming panels, (ii) bottom-forming panels foldably connected to the sidewall-forming panels, and (iii) flaps foldably connected to the bottom-forming panels, separation of the sidewall-forming panels causing the bottom-forming panels to form the carton bottom; said process comprising the steps:

(a) positioning the blank in forming station so that the bottom-forming panels contact the bottom-supporting means;

(b) placing the separating means between the sidewall-forming panels so that the separating means contact the insides of the sidewall-forming panels;

(c) moving the separating means apart, thereby moving the sidewall-forming panels apart and causing the bottom-forming panels to fold inwardly, the inward folding causing the sidewall-forming panels to move towards the bottom-supporting means and away from the separating means; and (d) moving the separating means towards the bottom-supporting means during step (c) so that the separating means continue to contact their respective sidewall-forming panels.

9. The process of claim 8 further comprising the steps:

(e) folding the flaps and securing them to the sides of the carton; and (f) ejecting the carton from the forming station.

* * * * *